US009401075B2

(12) United States Patent
Nicely et al.

(10) Patent No.: US 9,401,075 B2
(45) Date of Patent: Jul. 26, 2016

(54) GAMING SYSTEM, METHOD AND DEVICE INCLUDING PLAYER/DEALER ROLE REVERSAL FOR MODIFIED BLACKJACK GAME

(75) Inventors: Mark C. Nicely, Daly City, CA (US); Paul D. Miltenberger, Las Vegas, NV (US); Scott A. Caputo, Santa Clara, CA (US)

(73) Assignee: IGT, Las Vegas, NV (US)

( * ) Notice: Subject to any disclaimer, the term of this patent is extended or adjusted under 35 U.S.C. 154(b) by 549 days.

(21) Appl. No.: 13/603,092

(22) Filed: Sep. 4, 2012

(65) Prior Publication Data

US 2012/0329543 A1 Dec. 27, 2012

Related U.S. Application Data

(62) Division of application No. 11/609,177, filed on Dec. 11, 2006, now Pat. No. 8,262,448.

(60) Provisional application No. 60/748,847, filed on Dec. 9, 2005.

(51) Int. Cl.
*A63F 9/00* (2006.01)
*G07F 17/32* (2006.01)

(52) U.S. Cl.
CPC ..... *G07F 17/3293* (2013.01); *G07F 17/32* (2013.01)

(58) Field of Classification Search
CPC .. A63F 2001/003; A63F 3/00157; A63F 1/00
USPC ..... 463/12
See application file for complete search history.

(56) References Cited

U.S. PATENT DOCUMENTS

| | | | |
|---|---|---|---|
| 4,582,324 | A | 4/1986 | Koza et al. |
| 5,647,798 | A | 7/1997 | Falciglia |
| 5,806,854 | A | 9/1998 | Coleman et al. |
| 5,823,879 | A | 10/1998 | Goldberg et al. |
| 5,855,514 | A | 1/1999 | Kamille |
| 5,857,678 | A | 1/1999 | Coleman et al. |
| 5,951,011 | A | 9/1999 | Potter et al. |
| 6,001,016 | A | 12/1999 | Walker et al. |
| 6,015,346 | A | 1/2000 | Bennett |

(Continued)

FOREIGN PATENT DOCUMENTS

| | | |
|---|---|---|
| AU | 2004222759 | 5/2006 |
| WO | WO 2005025701 | 3/2005 |
| WO | WO 2006077560 | 7/2006 |

OTHER PUBLICATIONS

Baccarat Description, printed from wikipedia.org on Oct. 4, 2006.

(Continued)

*Primary Examiner* — Seng H Lim
(74) *Attorney, Agent, or Firm* — Neal, Gerber & Eisenberg LLP

(57) ABSTRACT

A modified version of a Blackjack game includes a plurality of Blackjack rules including at least one player rule and at least one dealer rule. The modified Blackjack game includes at least one deck of cards, a plurality of participant hands formable from the deck, and a plurality of game administrator hands formable from the deck. A game outcome can be produced by applying the player rule to at least one of the game administrator hands, and by applying the dealer rule to at least one of the participant hands.

17 Claims, 20 Drawing Sheets

(56) References Cited

U.S. PATENT DOCUMENTS

| | | | |
|---|---|---|---|
| 6,062,979 | A | 5/2000 | Inoue |
| 6,102,798 | A | 8/2000 | Bennett |
| 6,110,041 | A | 8/2000 | Walker et al. |
| 6,149,156 | A | 11/2000 | Feola |
| 6,159,098 | A | 12/2000 | Slomiany et al. |
| 6,174,235 | B1 | 1/2001 | Walker et al. |
| 6,174,237 | B1 | 1/2001 | Stephenson |
| 6,237,917 | B1 | 5/2001 | Timpano |
| 6,261,177 | B1 | 7/2001 | Bennett |
| 6,293,864 | B1 | 9/2001 | Romero |
| 6,309,300 | B1 | 10/2001 | Glavich |
| 6,312,334 | B1 | 11/2001 | Yoseloff |
| 6,325,375 | B1 | 12/2001 | Potter et al. |
| 6,331,144 | B1 | 12/2001 | Walker et al. |
| 6,358,147 | B1 | 3/2002 | Jaffe et al. |
| 6,364,314 | B1 | 4/2002 | Canterbury |
| 6,375,187 | B1 | 4/2002 | Baerlocher |
| 6,386,975 | B1 | 5/2002 | Peterson |
| 6,425,828 | B2 | 7/2002 | Walker et al. |
| 6,439,995 | B1 | 8/2002 | Hughs-Baird et al. |
| 6,506,118 | B1 | 1/2003 | Baerlocher et al. |
| 6,547,246 | B2 | 4/2003 | Webb |
| 6,561,902 | B1 | 5/2003 | Walker et al. |
| 6,575,831 | B1 | 6/2003 | Gonen et al. |
| 6,582,302 | B2 | 6/2003 | Romero |
| 6,585,586 | B1 | 7/2003 | Romero |
| 6,602,137 | B2 | 8/2003 | Kaminkow et al. |
| 6,605,001 | B1 | 8/2003 | Tarantino |
| 6,607,438 | B2 | 8/2003 | Baerlocher et al. |
| 6,632,141 | B2 | 10/2003 | Webb et al. |
| 6,648,754 | B2 | 11/2003 | Baerlocher et al. |
| 6,656,047 | B1 | 12/2003 | Tarantino et al. |
| 6,733,386 | B2 | 5/2004 | Cuddy et al. |
| 6,742,781 | B1 | 6/2004 | Bartlett |
| 6,746,332 | B1 | 6/2004 | Ing et al. |
| 6,789,801 | B2 | 9/2004 | Snow |
| 6,805,628 | B2 | 10/2004 | Romero |
| 6,837,494 | B2 | 1/2005 | Lee |
| 6,860,810 | B2 | 3/2005 | Cannon et al. |
| 6,866,267 | B1 * | 3/2005 | Hesse ..... 273/292 |
| 6,896,614 | B2 | 5/2005 | Romero |
| 6,908,390 | B2 | 6/2005 | Nguyen et al. |
| 6,916,245 | B1 | 7/2005 | Vancura et al. |
| 7,004,534 | B2 | 2/2006 | Yoshii et al. |
| 7,066,815 | B2 | 6/2006 | Walker et al. |
| 7,081,050 | B2 | 7/2006 | Tarantino |
| 7,114,724 | B2 | 10/2006 | Ritzer et al. |
| 2002/0132660 | A1 * | 9/2002 | Taylor ..... G07F 17/32 463/16 |
| 2003/0050111 | A1 | 3/2003 | Saffari |
| 2003/0199313 | A1 * | 10/2003 | Gonen et al. ..... 463/25 |
| 2003/0199320 | A1 | 10/2003 | Nguyen et al. |
| 2005/0143158 | A1 * | 6/2005 | Odom ..... A63F 1/00 463/13 |
| 2005/0187018 | A1 | 8/2005 | Takeda et al. |
| 2005/0192093 | A1 | 9/2005 | Sato |
| 2005/0192094 | A1 | 9/2005 | Okada et al. |
| 2005/0239525 | A1 | 10/2005 | Sato |
| 2005/0239526 | A1 | 10/2005 | Takeda |
| 2005/0282623 | A1 | 12/2005 | Matsuno et al. |
| 2006/0040732 | A1 | 2/2006 | Baerlocher et al. |
| 2006/0046822 | A1 | 3/2006 | Kaminkow et al. |
| 2006/0046839 | A1 | 3/2006 | Nguyen |
| 2006/0166726 | A1 | 7/2006 | Chun |
| 2006/0178181 | A1 | 8/2006 | Chun |
| 2006/0226605 | A1 | 10/2006 | Kenny |
| 2006/0232009 | A1 | 10/2006 | Lowery et al. |
| 2006/0287068 | A1 * | 12/2006 | Walker et al. ..... 463/25 |
| 2007/0032283 | A1 | 2/2007 | Chun |
| 2007/0032286 | A1 | 2/2007 | Muir |
| 2007/0075495 | A1 | 4/2007 | Mostashari |
| 2007/0077988 | A1 | 4/2007 | Friedman |
| 2007/0090598 | A1 | 4/2007 | Regos |

OTHER PUBLICATIONS

Baccarat Description, printed from www.gambling-baccarat.com on Feb. 22, 2007, available prior to Nov. 2006.

Shuffle Master, Vegas Star game description, printed from http://www.shufflemaster.com on May 2, 2007.

* cited by examiner

GAMING SYSTEM, METHOD AND DEVICE INCLUDING PLAYER/DEALER ROLE REVERSAL FOR MODIFIED BLACKJACK GAME

PRIORITY CLAIM

This application is a divisional of, and claims priority to and the benefit of, U.S. patent application Ser. No. 11/609,177, filed on Dec. 11, 2006, which is a non-provisional of, and claims priority to and the benefit of, U.S. Provisional Patent Application No. 60/748,847, filed on Dec. 9, 2005, the entire contents of each of which are incorporated herein by reference.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

There are a variety of games to play in casinos and other gaming environments. Blackjack or Twenty-One is one commonly known game which includes a player playing against a dealer. The person or entity playing the game is at times referred to herein as the "participant." The role that the participant would normally take in a traditional game of Blackjack is at times referred to herein as the "player." The person, gaming device, or other entity that administers the game is at times referred to herein as the "game administrator," The role that the game administrator normally takes in a traditional game of Blackjack is referred to at times herein as the "dealer." The game can be played at a gaming table with a live game administrator, through a stand alone gaming machine, or though a computer network such as the internet. Blackjack hands are scored by their point total. The winning hand is the hand which has the highest value and does not exceed the value of twenty-one.

There is a need to increase the level of interest, excitement and intrigue associated with playing Blackjack-related games. There is also a need to provide improvements to, and interesting variations of, Blackjack-related games.

SUMMARY

The embodiments of the present disclosure provide a modified Blackjack game or game of Twenty-One. The game includes multiple rounds of play. In each round, a participant can play two or more hands. The first hand in one round is played according to conventional American Blackjack rules where the player plays as a player against the game administrator. The game administrator can be a human game administrator, a human game administrator operating in a casino, a feed or transmission of a video of a game administrator operating in a live game, through a real-time video feed of a live game, a computer dealer, a virtual dealer of a casino, a gaming device, a gaming establishment, or a gaming system provided through a data network such as the internet. In the second hand in another round, the player or participant switches roles and plays the role of the game administrator. As such, the participant assumes the game administrator role and plays against the game administrator, where the game administrator assumes the role of the participant. The participant or game administrator can each place an equal initial wager on the game and can each receive an award based on their respective wagers.

In one embodiment, two cards are dealt to the participant face-up to form the initial participant hand for the first round of play. Also, one card is initially dealt face-up and one card is dealt face-down to form the game administrator hand for the first round of play. The participant is the first to act by standing, doubling-down, splitting, or hitting a number of times until the participant busts or achieves a hand or hands of a desired amount, according to whichever rules of Blackjack have been established for the game. Then, the game administrator reveals the game administrator down card and hits or stands according to a predetermined set of or conventional Blackjack dealer rules. Upon advancement to the second round, the participant and the game administrator are each dealt a second hand. Two cards are dealt to the game administrator face-up to form the second game administrator hand for the second round of play. Also, one card is initially dealt face-up and one card is dealt face-down to form the second participant hand for the second round of play. In the second round, the game administrator proceeds as a player against the participant and is therefore the first to act and is able to stand, double-down, split, or hit a number of times until the game administrator, acting as the player, busts or achieves a hand of a desired amount. The game administrator plays the second game administrator hand according to the conventional Blackjack player rules or according to modified Blackjack player rules. In one embodiment, the game administrator is allowed to use the game administrator's knowledge of the cards already eliminated from the deck, in addition to knowledge about the game administrator's participant hand and the participant's up-card in order to execute optimal play decisions. After the game administrator, acting as participant, has played out the second game administrator hand, the participant, playing the role of the dealer, hits or stands according to conventional or modified Blackjack dealer rules. Thus, there is a role reversal in the second round, where the participant is given the chance to play as the game administrator. Also in the second round, the player or dealer rules may be modified from the conventional Blackjack rules to limit the participant's liability in the second round or to affect the overall participant or game administrator advantage.

In one embodiment, a modified Blackjack game or game of Twenty-One includes a set of rules that provides the gaming establishment a slight statistical advantage over the participant (assuming the participant plays optimally). To maintain the house advantage, if the participant busts, the participant loses, even if the game administrator also busts. Therefore, the participant has a distinct disadvantage by having to act first. Despite this disadvantage, the participant is typically afforded several advantages such as having the opportunity to double-down, split cards, re-split cards and double-down on split cards. Even if the participant plays with a perfect basic strategy and takes advantage of all the splitting and double-down opportunities, the net effect is still a slight house advantage. In certain of the embodiments described herein, where the participant is allowed to play the role of the dealer in a second hand, the game provides the participant an opportunity to play at least one hand where participant has a slight advantage over the house. Although the net effect of the first hand and the second hand is a slight house advantage, the participant is still allowed to play a portion of the game having a statistical advantage. This provides added enjoyment and participant excitement because the participant is allowed the opportunity to edge out the house, for at least a portion of the game. In other embodiments, the standard Blackjack rules can be such as to allow a participant, using perfect strategy, a slight statistical edge over the game administrator. In an embodiment where both the participant and the game administrator enjoy the same rules when playing their respective participant hands, irrespective if the standard game rules favor the player role or the dealer role, such a game would have a break-even expected statistical return for a participant who employed perfect play strategy.

In an embodiment, the participant makes an initial wager or bet for the first participant hand. Additionally, when the participant is playing or assuming the role of the game administrator, the participant must have sufficient chips, credits, cheques, money or other acceptable assets to cover possible losses in the second round. The casino must place a matching bet to play against the participant. Once the bets are placed, the participant and the game administrator each receive at least four cards. Both the participant and game administrator examine their respective card without revealing these cards to their opponent and then select a two-card first hand and a two-card second hand from their initial cards. In an embodiment where more than four cards are initially dealt to a participant or to a game administrator, excess cards which are not set into a first two-card hand nor into a second two-card hand are discarded.

The first round is played out in conventional Blackjack fashion wherein the participant plays against the game administrator. The second round is played out with the game administrator assuming the role of the player and the participant assuming the role of the dealer.

In an embodiment, rules describe how the participant may select his initial hands. In an embodiment, rules describe how the game administrator may select the game administrator's hands. For example, in an embodiment, if a given participant's or game administrator's initial four cards include at least one card having a ten value (e.g., Ten, Jack, Queen, or King) and one Ace, the participant or the game administrator are required to combine them in the first hand to form a Blackjack. Another example would include a rule that requires a first hand to be of higher Blackjack value than that of the second hand relative to a definition of two-card Blackjack hand values.

In an embodiment, if the first participant hand is a natural Blackjack, then the second hand is not played out. In another embodiment, if the first game administrator hand is a natural Blackjack, then the second hand is not played out unless the participant also holds a Blackjack in the first participant hand.

In one embodiment, the first round and the second round (if played) are played under identical rules. In another embodiment, the first round is played according to one set of rules and the second round is played according to a different set of rules. For example, in the first round the game administrator may be required to take a hit on a soft-17 whereas in the second round, the participant acting as the dealer may be required to stay on a soft-17.

In another example, to limit or reduce the participant's bank liability on the second round, the game administrator is not allowed to double-down after splitting cards in the second game administrator hand. That is, when the game administrator is playing the role of the player in the second round, there is a limit placed on the number of times that the game administrator may make play decisions that would affect the overall liability of the participant (i.e., through splitting, doubling-down). However, the participant is allowed to double-down after splitting in the first round.

In another embodiment, the rules are such that the participant may elect not to play the first or second round after the participant has seen his/her initial four cards and before the first round has started. Thus, the participant must make this decision before the game administrator selects the first and second game administrator hands. In another embodiment, the rules are such that the participant may elect not to play the second round after the participant has seen his/her initial four cards and before the first round has started. Thus, the participant must make this decision before the game administrator selects the first and second game administrator hands. In another embodiment, the rules are such that the participant may elect not to play the first round or the second round or both rounds after the participant has seen his/her initial cards and before the first round has started by the forfeiture of half of the participant's initial wager. Thus, the participant must make this decision before the game administrator selects the first and second game administrator hands.

Additional features and advantages are described herein, and will be apparent from, the following Detailed Description and the figures.

DETAILED DESCRIPTION

Gaming System for Modified Blackjack

Figure 1A:
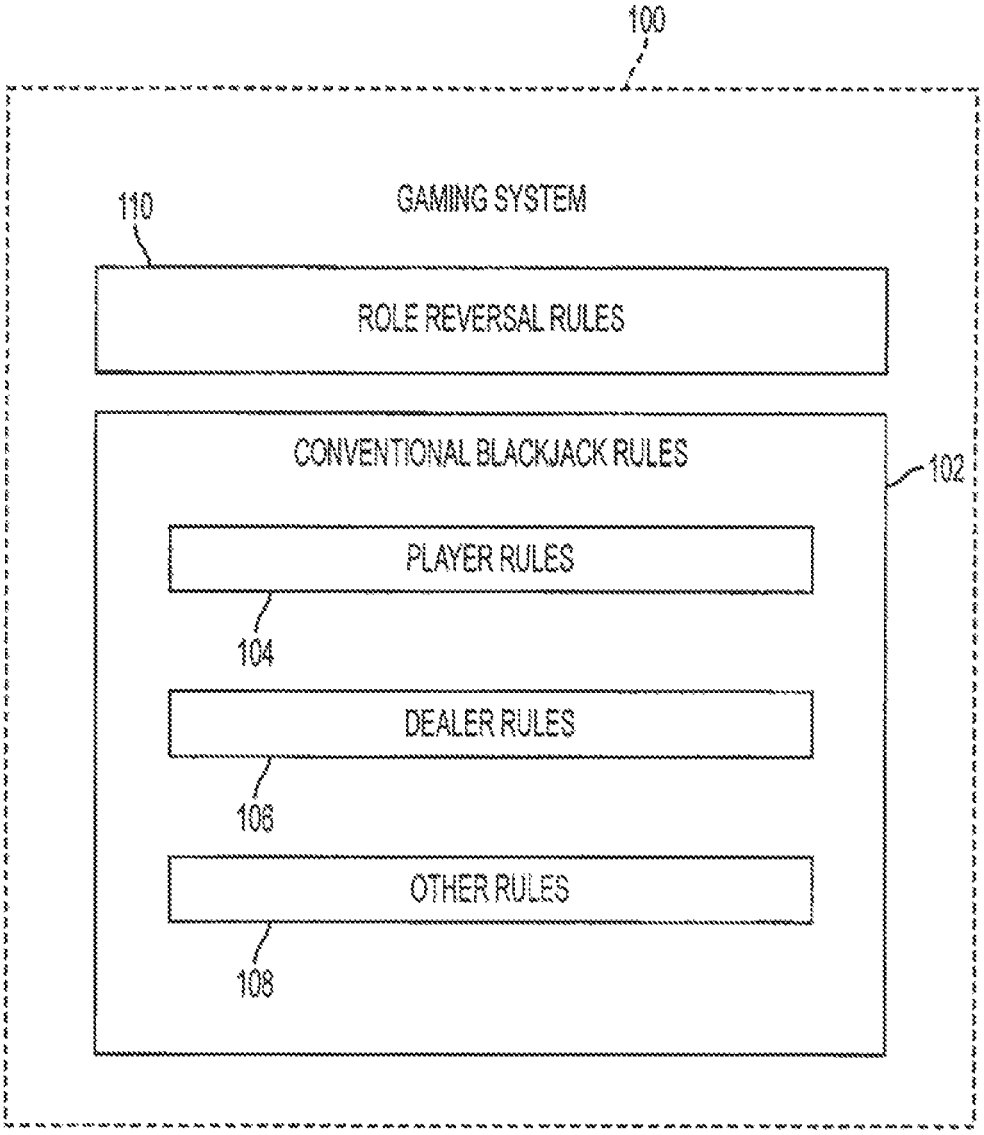
FIG. 1A is a schematic diagram of the gaming system according to an embodiment.

Referring to FIG. 1A, in an embodiment, a gaming system 100 is provided for playing a modified Blackjack game 200 having a game play 201 involving multiple rounds 114 and 116. The gaming system 100 includes conventional Blackjack rules 102 and role reversal rules 110. The conventional Blackjack rules 102 include player rules 104, dealer rules 106 and other rules 108. The player rules 104 include player rules for hitting, standing, doubling-down, and splitting. The dealer rules 106 include dealer rules relating to hitting and standing. The other rules 108 include rules relating to wagering, and rules relating to game play. The role reversal rules 110 designate or assign the player rules 104 and dealer rules 106 to a particular participant hand or game administrator hand. In one example, where the modified Blackjack game includes multiple hands or rounds in a given play of the game, the role reversal rules 110 function as a rule modifier to: (a) assign one or more of the player rules 104 to one participant hand; (b) assign one or more of the dealer rules 106 to one game administrator hand; (c) assign one or more of the dealer rules 106 to a different participant hand; and (d) assign one or more of the player rules 104 to a different game administrator hand.

Figure 1B:
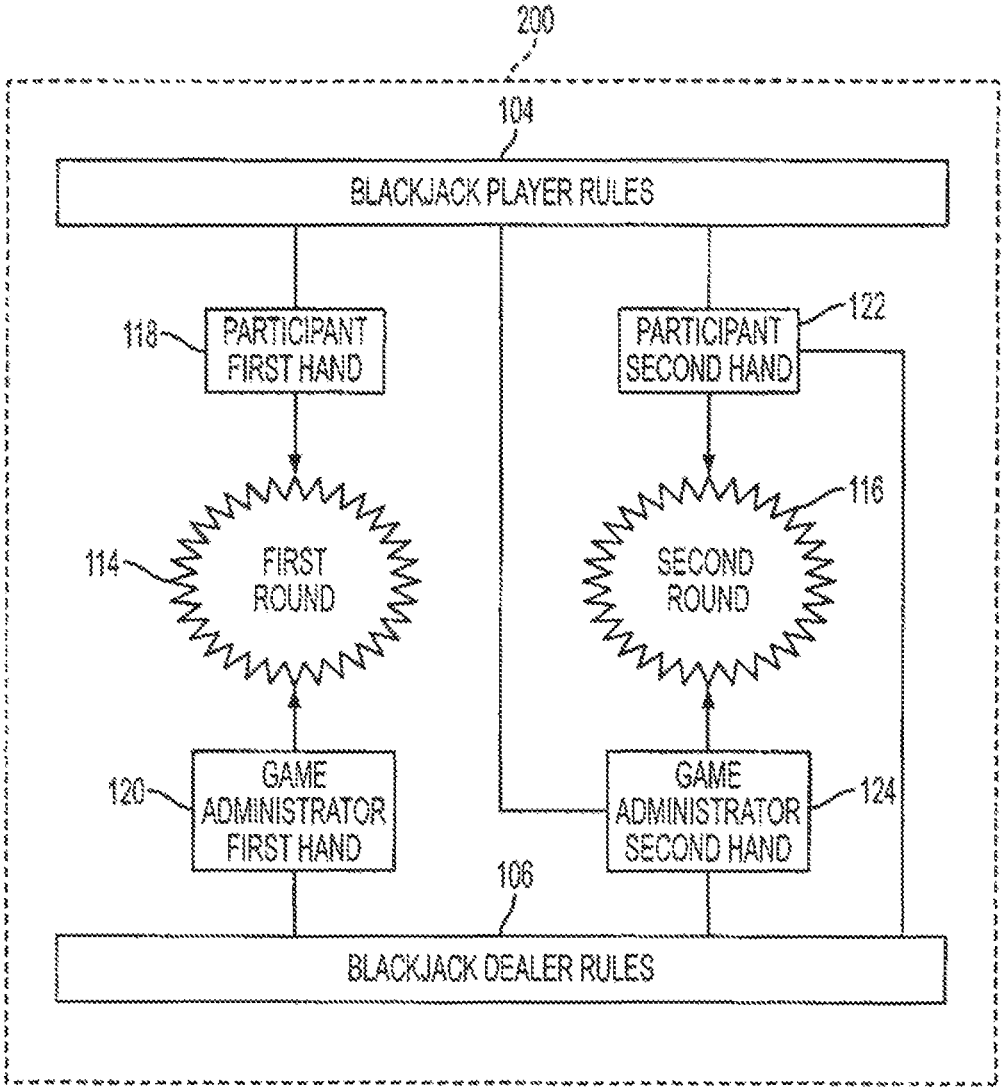
FIG. 1B is a schematic diagram of an embodiment illustrating the rules applicable to a first round and a second round of a given play of a modified Blackjack game.

In one embodiment illustrated in FIG. 1B, the Blackjack player rules 104 allow: (a) splitting of cards once if the two cards in the two-card hand are of the same rank; (b) doubling-down; (c) no offer for insurance if the opponent's face-up card is an Ace; and (d) no doubling-down after splitting cards. In an embodiment, the Blackjack dealer rules 106: (a) require a hit if the total value of the cards in the hand is less than seventeen; (b) prevent a hit if the hand is a soft-seventeen or higher soft total less than twenty-two; and (c) prevent a hit if the total value of the cards in the hand is a hard seventeen or greater.

Referring to FIG. 1B, in one example, the participant 100 plays a first participant hand 118 against the first game administrator hand 120 in a first round 114 of play. In round 114, the participant plays according to the player rules 104, and the game administrator plays according to dealer rules 106. If the participants advance to a second round 116, the participant plays the second participant hand 122 against the second game administrator hand 124. In the second round 116, the participant plays according to dealer rules 106, and the game administrator plays according to player rules 104.

It should be appreciated that the term "participant," as used herein, can refer to a participant of the game 200 to describe an individual who is participating in placing the wagers and receiving any awards as an outcome of the game 200. It should also be appreciated that the term "game administrator," as used herein, can refer to a game facilitator, operator or administrator to describe an individual who is performing the role of administering the game 200, receiving wagers, and providing any awards to the player or participant upon an outcome of the game 200. Thus, in one embodiment, in the first round 114, the participant plays according to the player rules 104, and the game administrator plays according to the dealer rules 106. In the second round 116, the participant plays according to the dealer rules 106, and the game administrator plays according to the player rules 104.

Referring generally to FIGS. 2 through 14, such figures show an example game layout where the participant position and hands are above the game administrator position and hands. It should be appreciated that, in other embodiments, the game layout can have any alternative suitable layout, such as one in which the game administrator position and hands are above the participant position and hands. For example, the participant area 202 (described below) can, in one embodiment, switch positions with the game administrator area 203 (described below). In one example illustrated in FIG. 2, a game administrator deals a multiple hand Blackjack related game 200 to a participant. As described further below, the game 200 can be implemented in a variety of embodiments, including, but not limited to: (a) a table play embodiment in which the cards are in paper form dealt on a table by a human game administrator; (b) a computerized embodiment in which the cards are displayed in virtual form on an electronic display device, where a processor performs the game administrator functions; and (c) game administrator functions; and (c) a table play embodiment in which the cards are in paper form dealt on a table by a human game administrator on a table with card tracking technology connected to a processor that can signal the game administrator by a display device how to make optimal game administrator play decisions.

Figure 2:
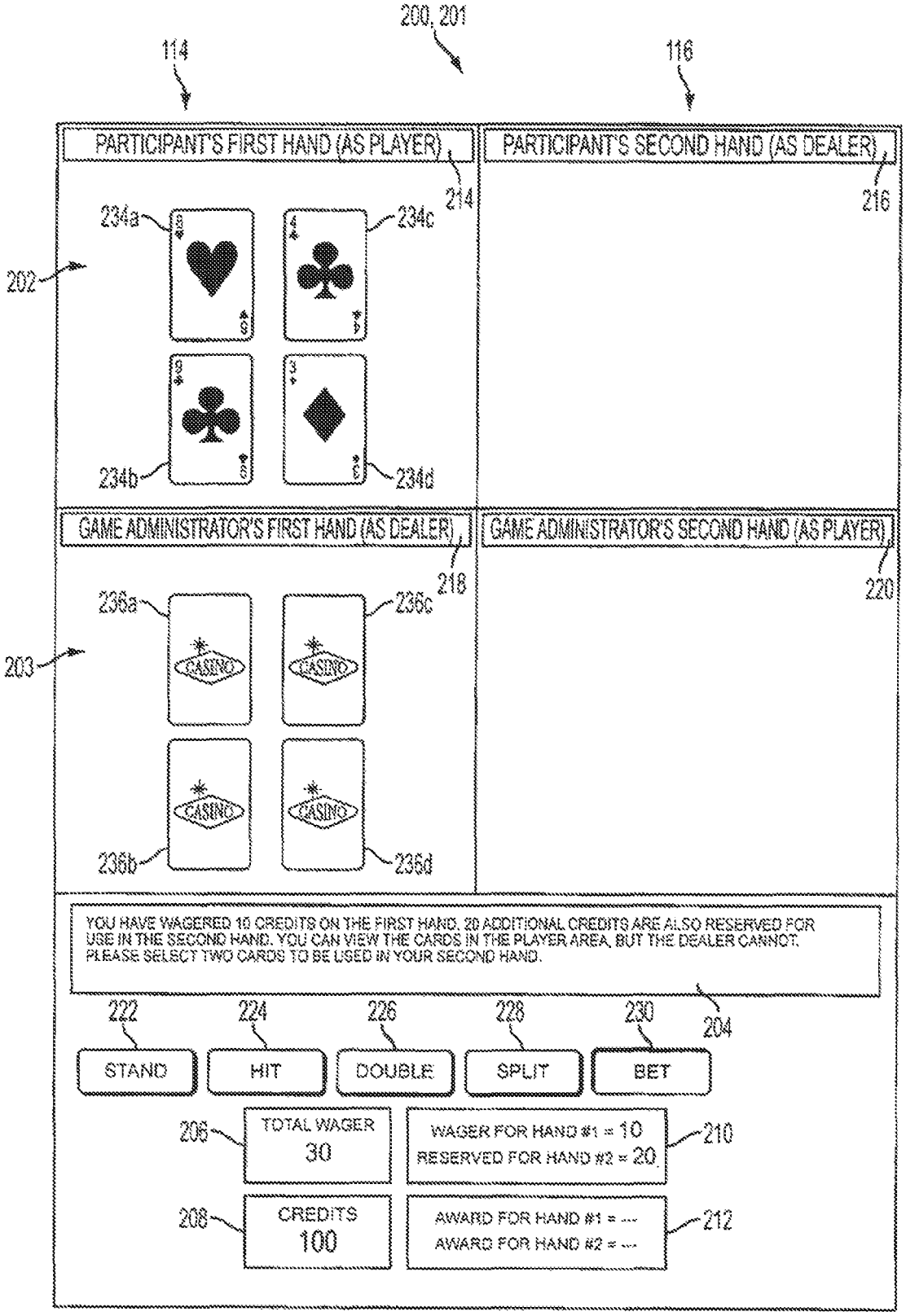
FIG. 2 is a top view for an example first round of one embodiment of the Blackjack game, where the game administrator deals a first set of participant cards and a first set of game administrator cards.

In the example illustrated in FIG. 2, a play 201 of the game 200 includes a first round 114 of play and a second round 116 of play. The first round 114 includes a first participant hand 214 and a first game administrator hand 218, and is played according to conventional Blackjack rules. The second round 116 includes a second participant hand 216 and a second game administrator hand 220, and is played according to conventional Blackjack rules, except that the participant plays the role of the game administrator and the game administrator plays the role of the player. In one embodiment, the game 200 includes: a participant area 202; a game administrator area 203; a general message area 204; a total wager message area 206; a credits area 208; a wager area 210 reflecting the participant's wager for hand one as well as the amount reserved for hand two; and an award display 212. The participant area 202 includes an area for play of the first participant hand 214, where the participant plays the role of the game administrator. Similarly, the game administrator area 203 includes an area where the first game administrator hand 218 is played, and an area where the second game administrator hand 220 is played. For the second game administrator hand 220, the game administrator plays the role of the player. The game 200 also includes a number of inputs that are typical for play of a Blackjack game. In one example, these inputs include: a stand input 222; a hit input 224; a double or double-down input 226; a split input 228; and a bet or wager input 230.

In one example play of the game 200, the participant makes a wager by inputting the amount with the wager input 230. In this example, the participant has wagered a total of thirty credits, as indicated in the total wager message area 206, and as indicated in the general message area 204. In this embodiment, of the total amount wagered, ten credits are applied as a wager to the first round 114, as indicated by the wager indicator or wager area 210. Also, twenty credits are reserved for use in the second round 116, as indicated by the wager area 210 and the general message area 204.

Referring to FIG. 2, the game administrator deals four cards, visible only to the participant to form the initial set of participant cards 234*a*, 234*b*, 234*c* and 234*d*. Similarly, the game administrator deals four cards in the game administrator area 203 to form the initial set of game administrator cards 236*a*, 236*b*, 236*c* and 236*d*. It should be appreciated that the cards may be dealt to the participant and game administrator in any suitable order. The game administrator then prompts the participant to select two cards of the initial set of participant cards 234*a*, 234*b*, 234*c* and 234*d*, as indicated by the general message area 204.

Figure 3:
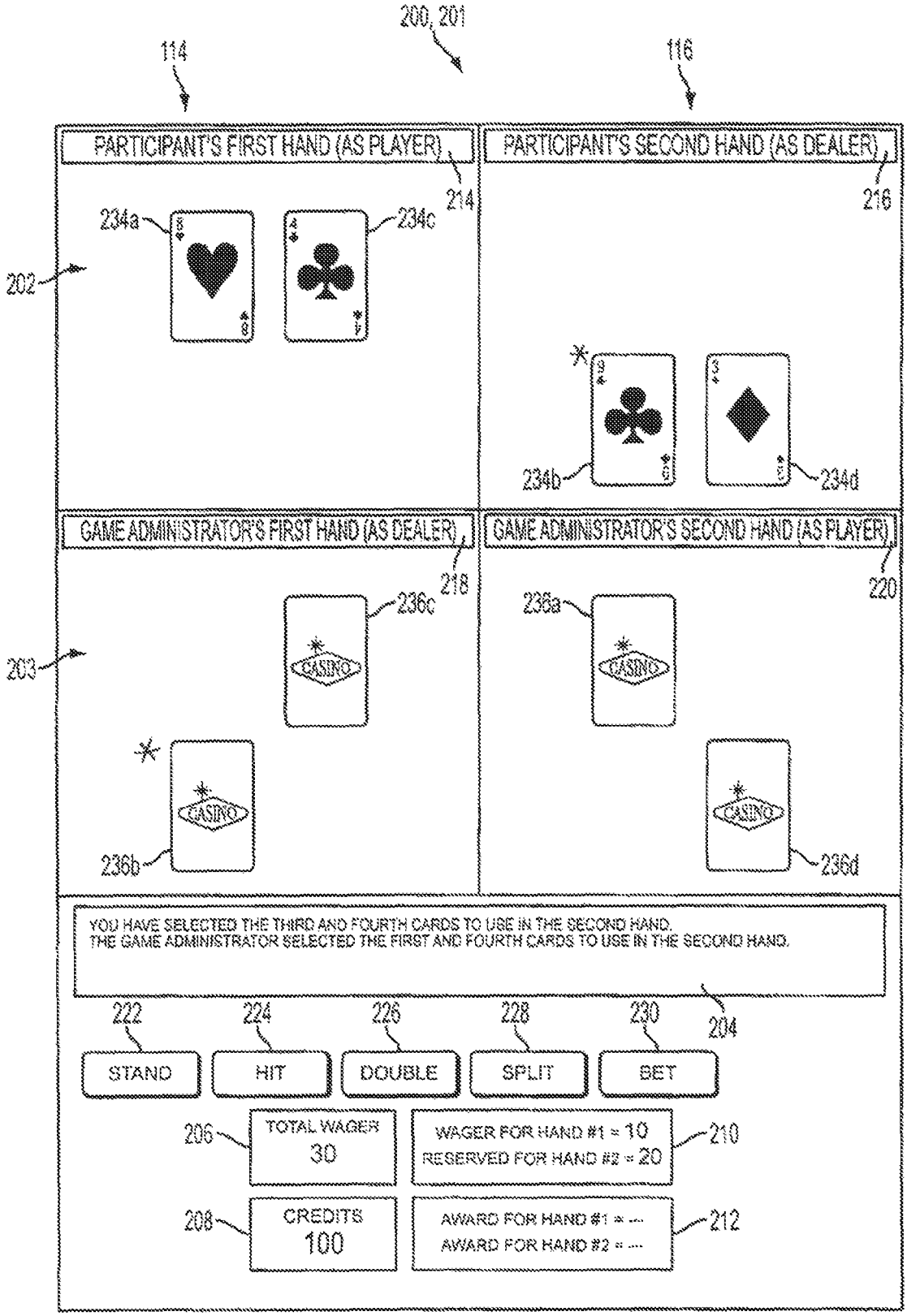
FIG. 3 is a top view of an example first round of one embodiment of the Blackjack game, where the participant and the game administrator select first and second hands.

Referring to FIG. 3, as indicated by the general message area 204, the participant, having viewed the initial set of participant card, selects cards 234*b* and 234*d* for use in the second participant hand 216 for round 116 of the play 201. Thus, cards 234*a* and 234*c* are used in the first participant hand 214 for round 114 of the play 201. In round 114, the participant plays according to conventional Blackjack rules 102, and cards 234*b* and 234*d* are used in the second participant hand 216, where the participant acts or plays the role of the game administrator. Similarly, the game administrator selects cards 236*a* and 236*d* to be used in the second game administrator hand 220 for round 116. Thus, cards 236*b* and 236*c* are used in the first game administrator hand 218 for round 114. In round 114, the first game administrator hand 218 is played according to conventional Blackjack rules 102. In round 116, the game administrator plays the role of participant, according to a set of conventional or modified participant rules 104. In this example, the participant selects one card 234*b* to be the face-up card in the second participant hand 216, as indicated by the asterisk in the participant card 234*b*. Similarly, the game administrator selects one card 236*b* in the game administrator's first hand 218 to be the face-up card. In another embodiment, as described in further detail below, the face-up cards in the participant's second hand 216 and the game administrator's first hand 218 are randomly determined by the gaming system 100.

Figure 4:
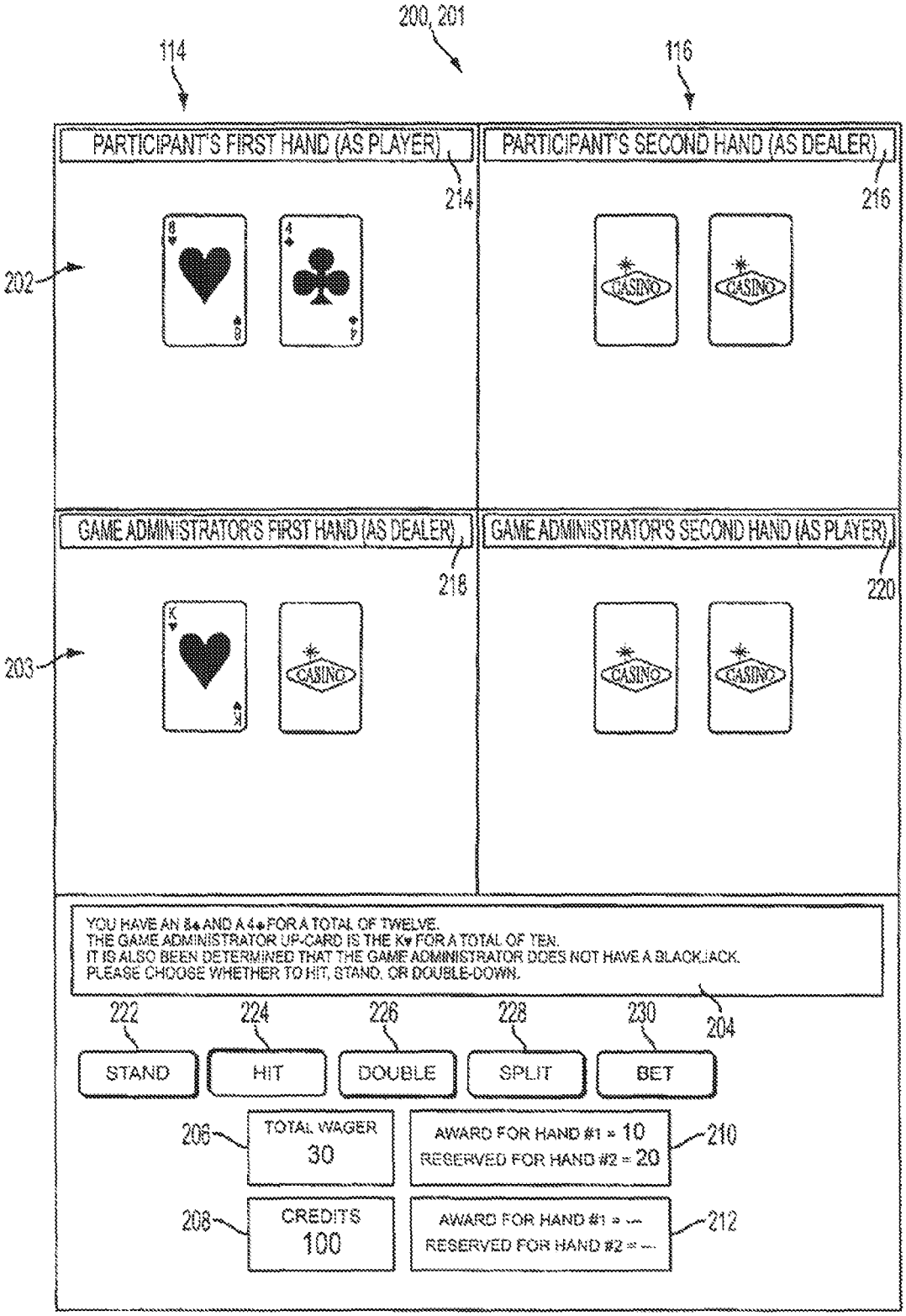
FIG. 4 is a top view of an example first play of one embodiment of the Blackjack game, where a first round is played out.

As illustrated in FIG. 4, and as indicated by the general message area 204, the game 200 reveals both of the cards in the first participant hand 214 and reveals only one card in the first game administrator hand 218, according to conventional Blackjack rules 102. The face-up card in the first game administrator hand 218 is the King of hearts (K♥) with a value of ten, as indicated by the general message area 204. Also, the cards in the first participant hand 214 are the eight of hearts and the four of clubs (8♥4♣). Thus, the total value of the initial two cards in the first participant hand 214 is twelve, as indicated by the general message area 204. In this particular first round 114, because the game administrator was dealt an face-up card with a value of ten, the game administrator must first determine if the game administrator has a Blackjack according to the dealer rules of this example. This prevents the participant from wagering additional moneys or credits if there is no chance for the participant to win. As indicated by the general message area 204, the game administrator does not, in this example, have a Blackjack in this first round 114. At this stage, the participant has the option to hit, stand or double-down according to convention Blackjack player rules 104. In this example, the participant chooses to hit. In an embodiment, the participant hits by touching, depressing or otherwise activating the hit input 224.

Figure 5:
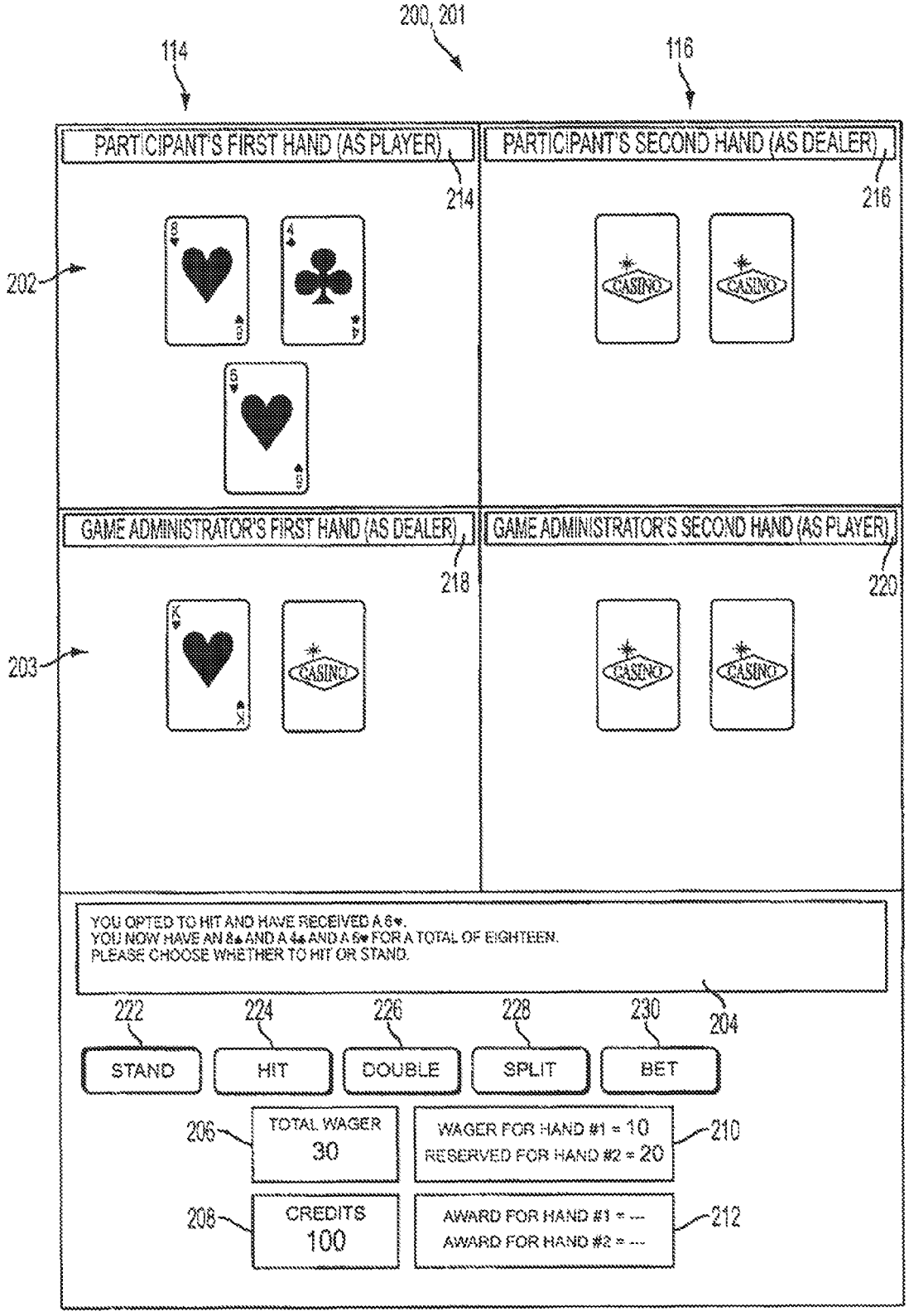
FIG. 5 is a top view of an example first play of one embodiment of the Blackjack game, where the first round is played out.

As illustrated in FIG. 5, the participant's hit card is the six of hearts (6♥). Thus, the total value of the first participant hand 214 at this point is eighteen, as indicated by the general message area 204. At this stage, the participant has the option to hit or stand. In this example, the participant chooses to stand by activating the stand input 222. Therefore, the first participant hand 214 is fully determined.

Figure 6:
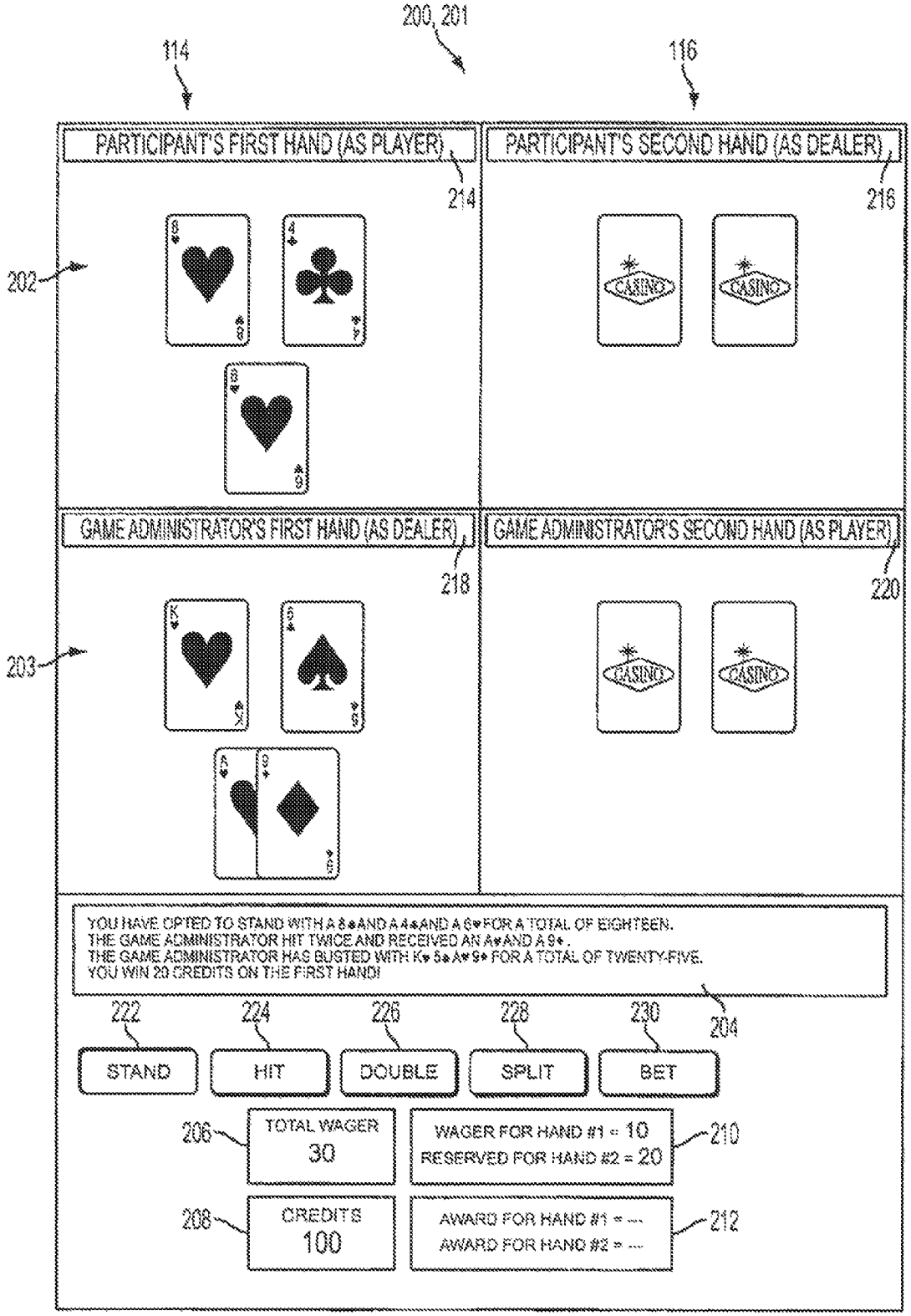
FIG. 6 is a top view of an example first play of one embodiment of the Blackjack game, where the first round is played out.

As illustrated in FIG. 6, the gaming device 200 reveals the down-card in the first game administrator hand 218. The game administrator down-card is the five of spades (5♠). According to conventional Blackjack dealer rules 106, the game administrator must hit on hand values that are less than seventeen. Therefore, in this example, the game administrator must hit because the total value of the first game administrator hand 218 at this point is only fifteen. The game administrator deals an Ace of hearts such that the value of the first game administrator hand 218 is sixteen (i.e., K♥5♠A♥). As outlined above, according to the conventional Blackjack dealer rules 106, the game administrator must deal another card because the value of the first game administrator hand 218 is still less than seventeen. Therefore, the game administrator deals another card which is a nine of diamonds such that the total value of the first game administrator hand 218 is now twenty-five (i.e., K♥5♠A♥9♦). Because the value of the first game administrator hand 218 has exceeded twenty-one, the game administrator has busted with regard to the first hand, as indicated by the general message area 204. The game administrator provides the participant with twenty credits (which is comprised of a one-to-one award of ten credits plus the return of the participant's wager as player, which is another ten credits) as indicated by the general message area 204. The total credits area 208 increases to a total of one-hundred twenty. Also the award area 212 indicates that the participant has won ten credits as the award for the first hand or first round 114.

Figure 7:
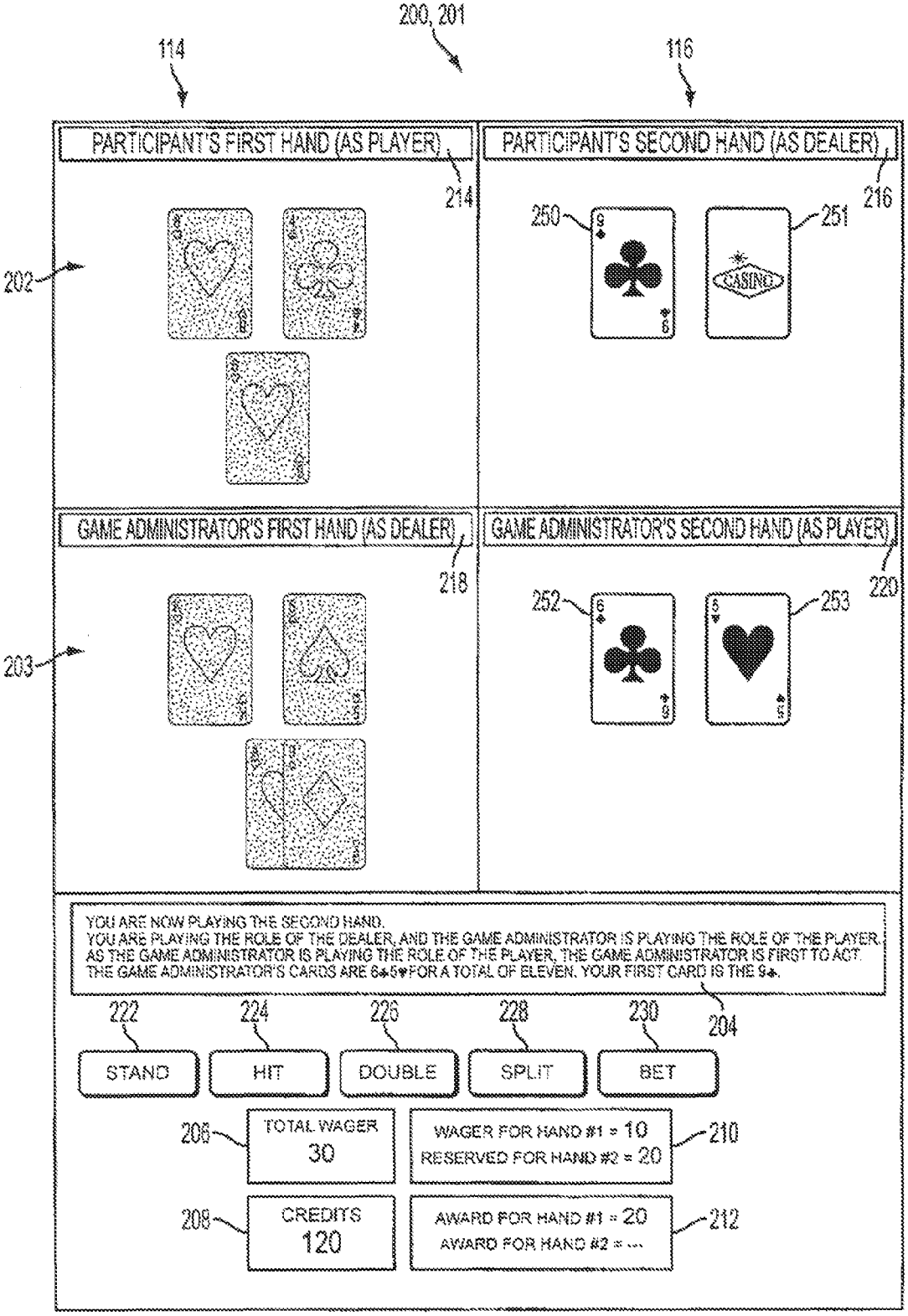
FIG. 7 is a top view of an example first play of one embodiment of the Blackjack game, where the second round is played out.

As illustrated in FIG. 7, the second hand or second round 116 begins with revealing one card in the second participant hand 216 and both cards in the second game administrator hand 220. Also, as indicated in the wager area 210, of the original thirty credit wager, twenty credits are reserved for use in the second round 116. In this second round 116, the participant plays the role of the dealer and the game administrator plays the role of the participant. As such, it follows that the participant is bound by a set of dealer rules 106 and the game administrator is bound by the set of player rules 104. In the illustrated example of the second round 116 in FIGS. 7 to 10, it is assumed that the set of player rules 104 and set of dealer rules 106 for the second round 116 are the same as the set of player rules 104 and the set of dealer rules 106 for the first round 114. However, it should be appreciated that the participant and dealer rules for the second round 116 may be different than the rules for the first round 114, as discussed in further detail below. As illustrated in FIG. 7, the initial two cards 252 and 253 in the second game administrator hand 220 include the six of dubs (6♣) and the five of hearts (5♥) for a total value of the second game administrator hand 220 of eleven, as indicated by the general message area 204. The face-up card in the second participant hand 216 is the nine of dubs (9♣). Because the game administrator plays the role of the participant in the second round 116, the game administrator is first to act.

Figure 8:
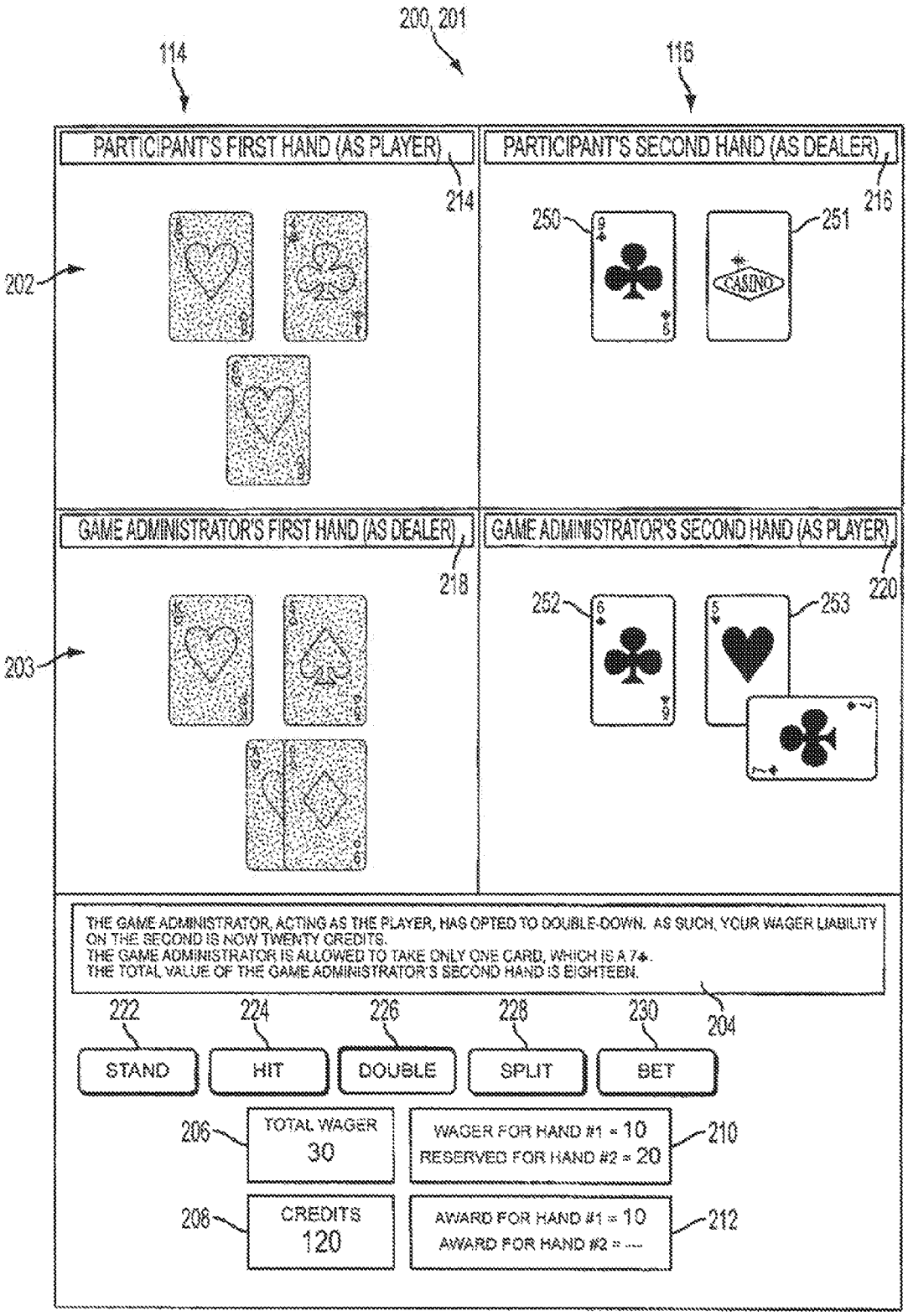
FIG. 8 is a top view of an example first play of one embodiment of the Blackjack game, where the second hand is played out, and where the game administrator doubles-down on the second game administrator hand.

As illustrated in FIG. 8, the initial two cards of the second game administrator hand 220 were the 6♣ and the 5♥ for a total of eleven. This is generally regarded as a very good double-down opportunity for a participant. Because the game administrator plays the role of the player in this second round 116, the game administrator elects to double-down. It should be appreciated that the card game system includes, in an embodiment, a suitable processor and at least one memory.

The memory includes a set of dealer rules 106 that govern the operation of the game 200 as the game administrator plays the role of the player. For example, the game administrator may be limited to playing optimal basic strategy. In the illustrated example of FIG. 7, the game administrator plays according to optimal participant strategy because it is advantageous for a participant to double-down with an eleven when the game administrator face-up card is a nine. As illustrated in FIG. 7, the game administrator, acting as the participant, has hit a seven of clubs such that the second game administrator hand 220 has a total of eighteen (i.e., 6♣ 5♥7♣ ), as further indicated by the general message area 204. Under this set of player rules 104 for the second round 116, the game administrator is limited to receiving one card after the game administrator doubles down.

Moreover, because the game administrator has doubled down according to the player rules 104, the participant's full wager liability is now in force. It should be appreciated that because the game administrator, acting as the player in the second round 116, has options to split or double-down, the participant's potential exposure or liability may be greater than the amount that the participant had originally wagered on the participant's first hand. In this example, the participant originally wagered thirty credits, ten credits for the first participant hand and a reserve of twenty for the maximum liability of the second participant hand. As described further below, the set of player rules 104 applicable to the second round 116 may include limitations on the total potential participant exposure. It should also be appreciated that in order for the participant to make a primary wager, the participant must have sufficient credits to cover the maximum potential liability resulting from the second hand. In another embodiment, the ability of the participant to take advantage of the splitting and doubling-down opportunities in the first round may be restricted if the participant does not have sufficient credits to cover the potential liability in the second round.

Figure 9:
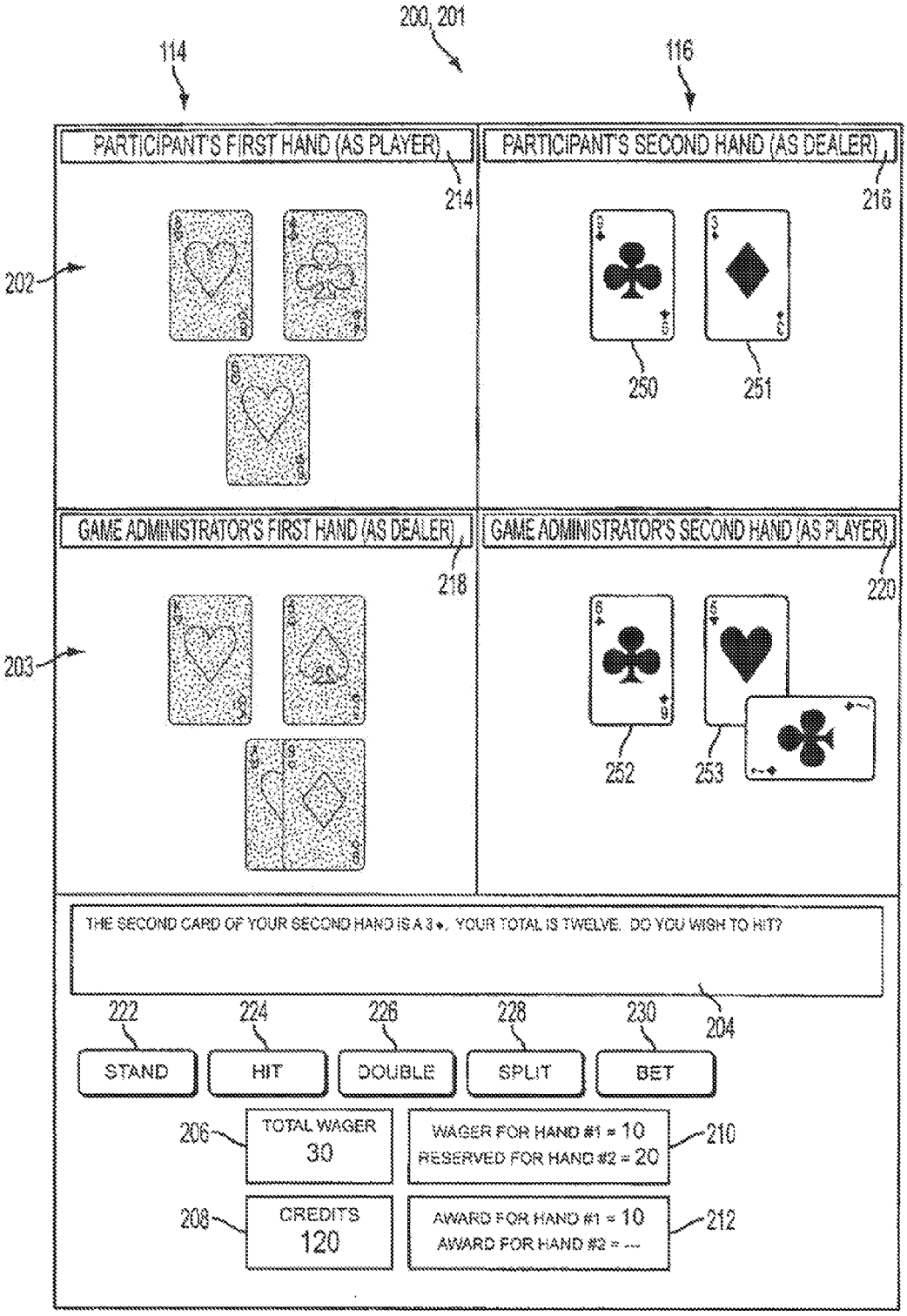
FIG. 9 is a top view of an example first play of one embodiment of the Blackjack game, where the second round is played out.

As illustrated in FIG. 9, the participant's down card 251 is revealed to be a three of diamonds. Therefore, the initial value of the second participant hand is twelve (i.e., 9♣ 3♦), as indicated by the general message area 204. As mentioned above, in this illustrated example, the rules governing the determination of the second participant hand 216 (i.e., where the participant is acting as the dealer) are the same as the rules governing the determination of the first dealer hand 218. Therefore, the participant is required to hit until the participant has at least a second participant hand 216 totaling seventeen or more.

Figure 10:
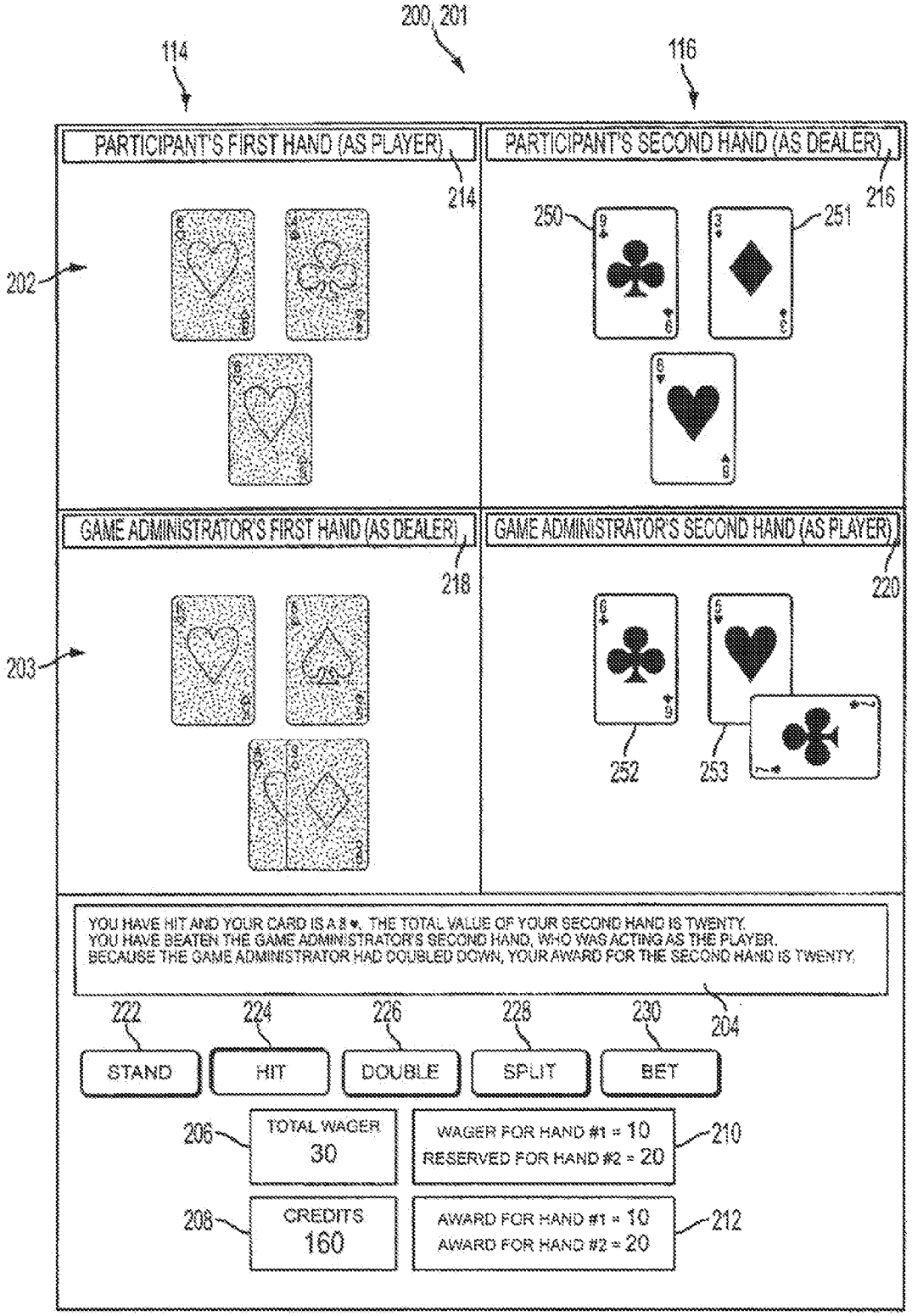
FIG. 10 is a top view of an example first play of one embodiment of the Blackjack game, where the second round is played out.

In this example, as illustrated in FIG. 10, the hit card for the second participant hand 216 is an eight of hearts (8♥). Thus, the total value of the second participant hand 216 is twenty, as indicated also by the general message area 204. Therefore, the game administrator, acting as the participant for this second round 116, loses to the participant, who is acting as the game administrator. Accordingly, because the participant was forced into a double-down situation by the game administrator in the second round, the participant reserve for the second hand is returned, and the participant is also awarded the twenty credits that the game administrator wagered on the game administrator's second hand, for a total of forty credits, as indicated by award display 212. The credits area 208 updates the total number of credits from one-hundred twenty to one-hundred sixty. In this example play of the game illustrated in FIGS. 2 to 10, the participant wins ten credits on the first round 114 and twenty credits on the second round 116. Thus, the participant's net winnings are thirty credits.

FIGS. 11 to 14 illustrate another play of the game 200, where the first game administrator hand 218 is a natural Blackjack or Twenty-One. In one example play of the game 200, the participant makes a bet or wager by inputting the amount, in one embodiment, using the wager input 230. In this example, the participant has wagered a total of sixty credits, as indicated in the total wager message area 206, and as indicated in the general message area 204. In this embodiment, of the total amount wagered, twenty credits are applied as a wager to the first round 114, as indicated in the wager area 210. Also, forty credits are reserved for use in the second round 116, as indicated in the wager area 210 and the general message area 204. The participant's cards are only visible to the participant until the participant puts them into play. The game administrator's cards are only visible to the participant until the game administrator puts them into play.

Figure 11:
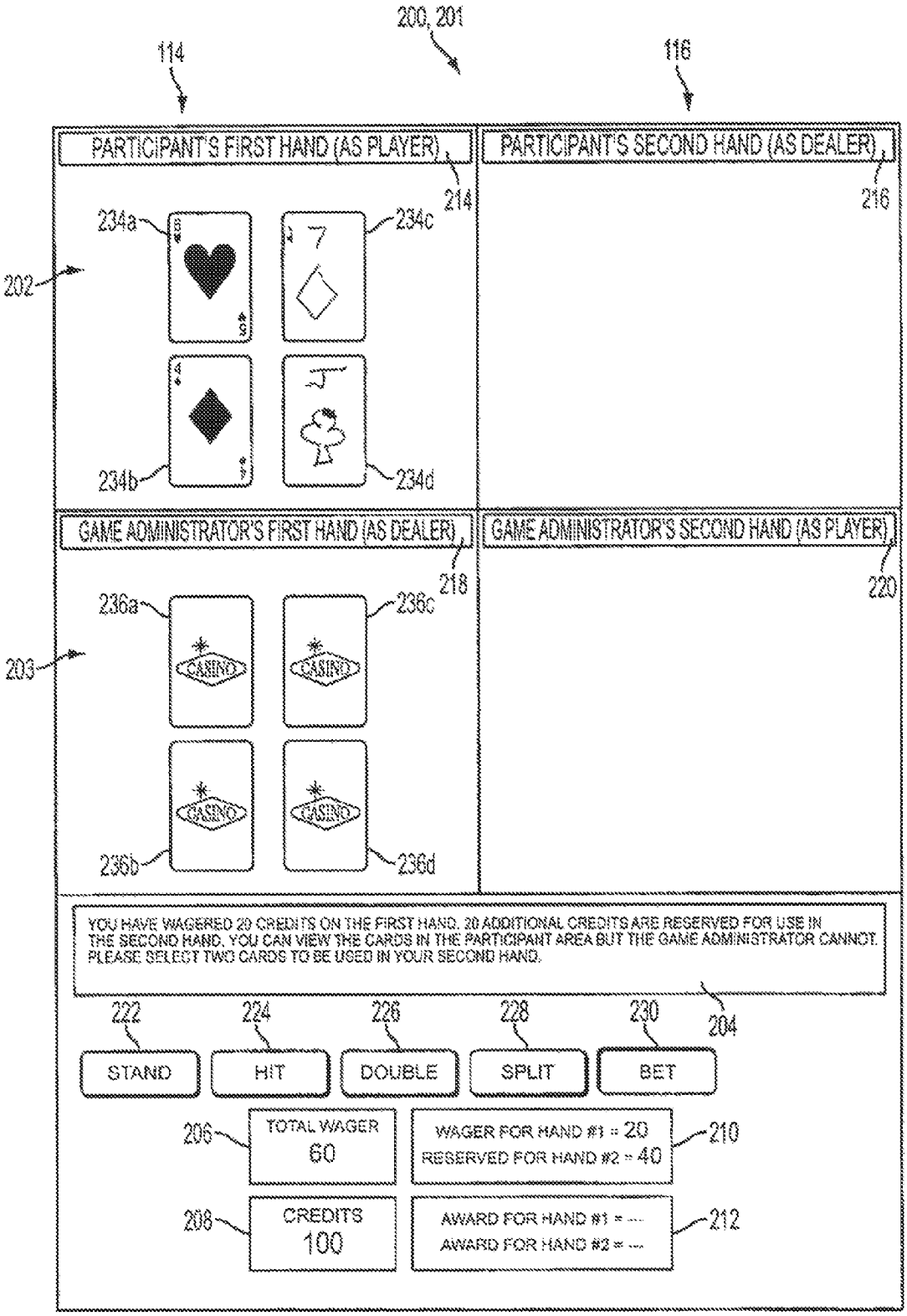
FIG. 11 is a top view of an example second play of one embodiment of the Blackjack game, where the game administrator deals a first set of participant cards and a first set of game administrator cards.

As illustrated in FIG. 11, the game administrator deals four cards to the participant to form the initial set of participant cards 234*a*, 234*b*, 234*c* and 234*d*. Similarly, the game administrator deals four cards in the game administrator area 203 to form the initial set of game administrator cards 236*a*, 236*b*, 236*c* and 236*d*. The game administrator then prompts the participant to select two cards of the initial set of participant cards 234*a*, 234*b*, 234*c* and 234*d*, as indicated by the general message area 204.

Figure 12:
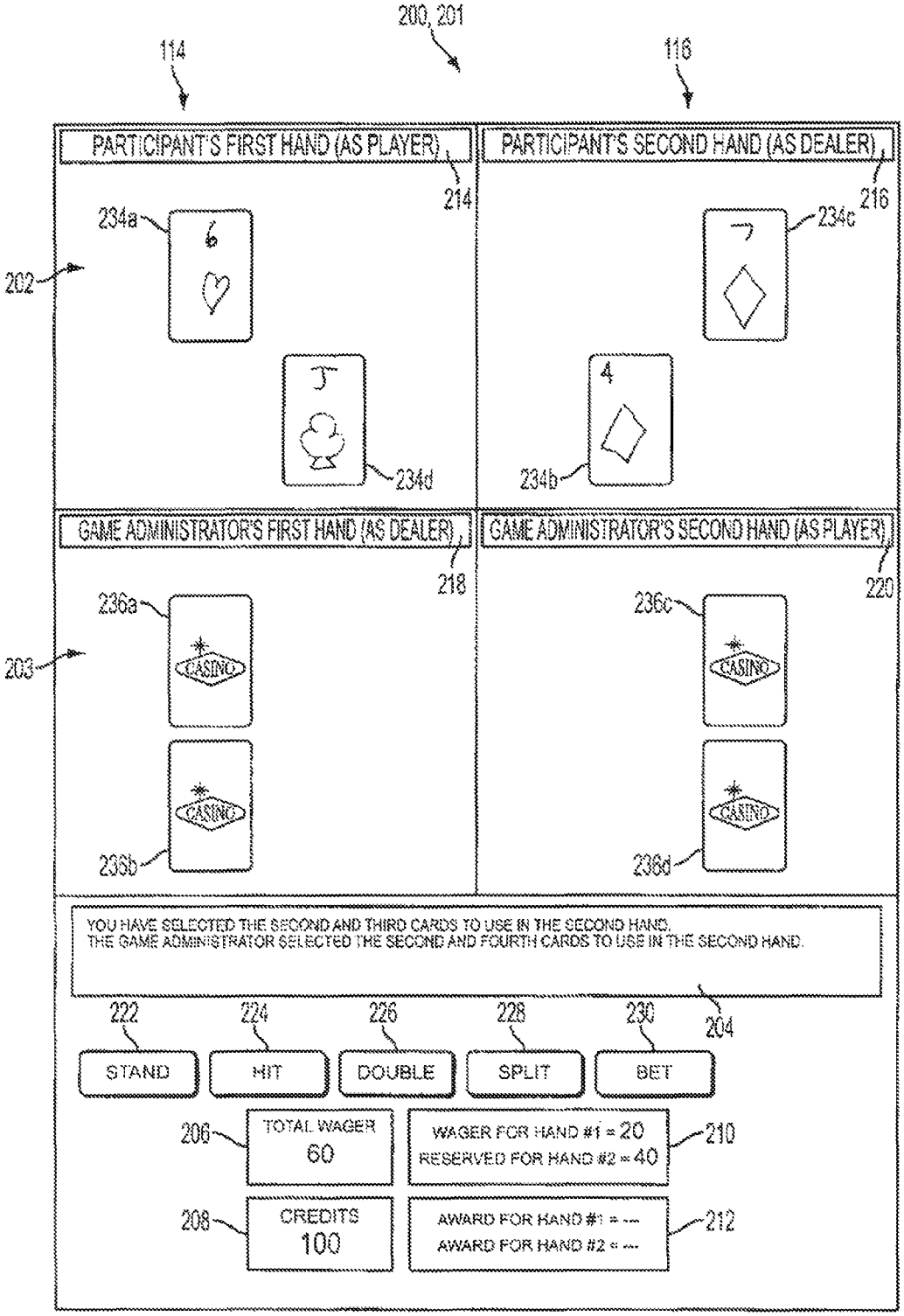
FIG. 12 is a top view of an example second play of one embodiment of the Blackjack game, where the participant and the game administrator select first and second hands.

As illustrated in FIG. 12, and as indicated by the general message area 204, the participant selects cards 234*b* and 234*c* to be used in the second participant hand 216. Thus, cards 234*a* and 234*d* are used in the first participant hand 214, where the participant plays as the player according to conventional Blackjack rules 102, and cards 234*b* and 234*c* are used in the second participant hand 216, where the participant acts or plays the role of the dealer. Similarly, the gaming device 200 selects card 236*c* and 236*d* to be used in the second game administrator hand 220. Thus, cards 236*a* and 236*b* are used in the first game administrator hand 218, where first the game administrator hand 218 is played according to conventional Blackjack rules 102, and the cards 236*c* and 236*d* are used in the second game administrator hand 220, where the game administrator plays the role of player, according to a set of conventional or modified player rules 104. As described above with reference to FIG. 1, in an embodiment, the gaming system 100 includes role reversal rules 110 that reverse the roles of the participant and the game administrator in the second round 116 by assigning the player rules 104 to the game administrator and by assigning the dealer rules 106 to the participant.

Figure 13:
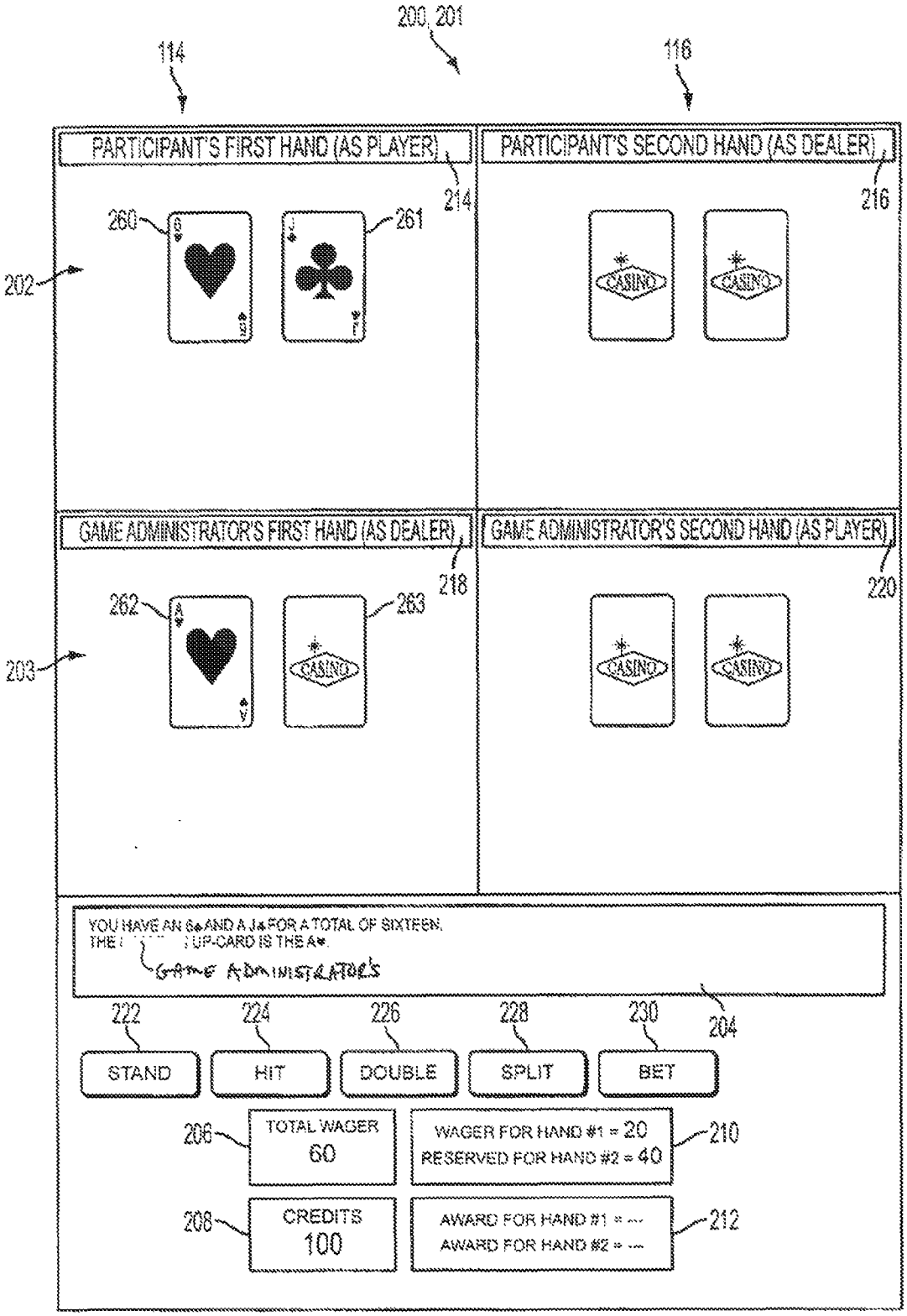
FIG. 13 is a top view of an example second play of one embodiment of the Blackjack game, where the first hand is played out.

In the example illustrated in FIG. 13, as indicated by the general message area 204, both of the cards 260 and 261 in the first participant hand 214 and only one card 262 in the first game administrator hand 218 are revealed according to conventional Blackjack rules 102. The face-up card 262 in the first game administrator hand 218 is the Ace of hearts (A♥), as indicated by the general message area 204. Also, the cards in the first participant hand 214 are the six of hearts and the Jack of clubs (6♥J♣ ). Thus, the total value of the initial two cards in the first participant hand 214 is fourteen, as indicated by the general message area 204.

Figure 14:
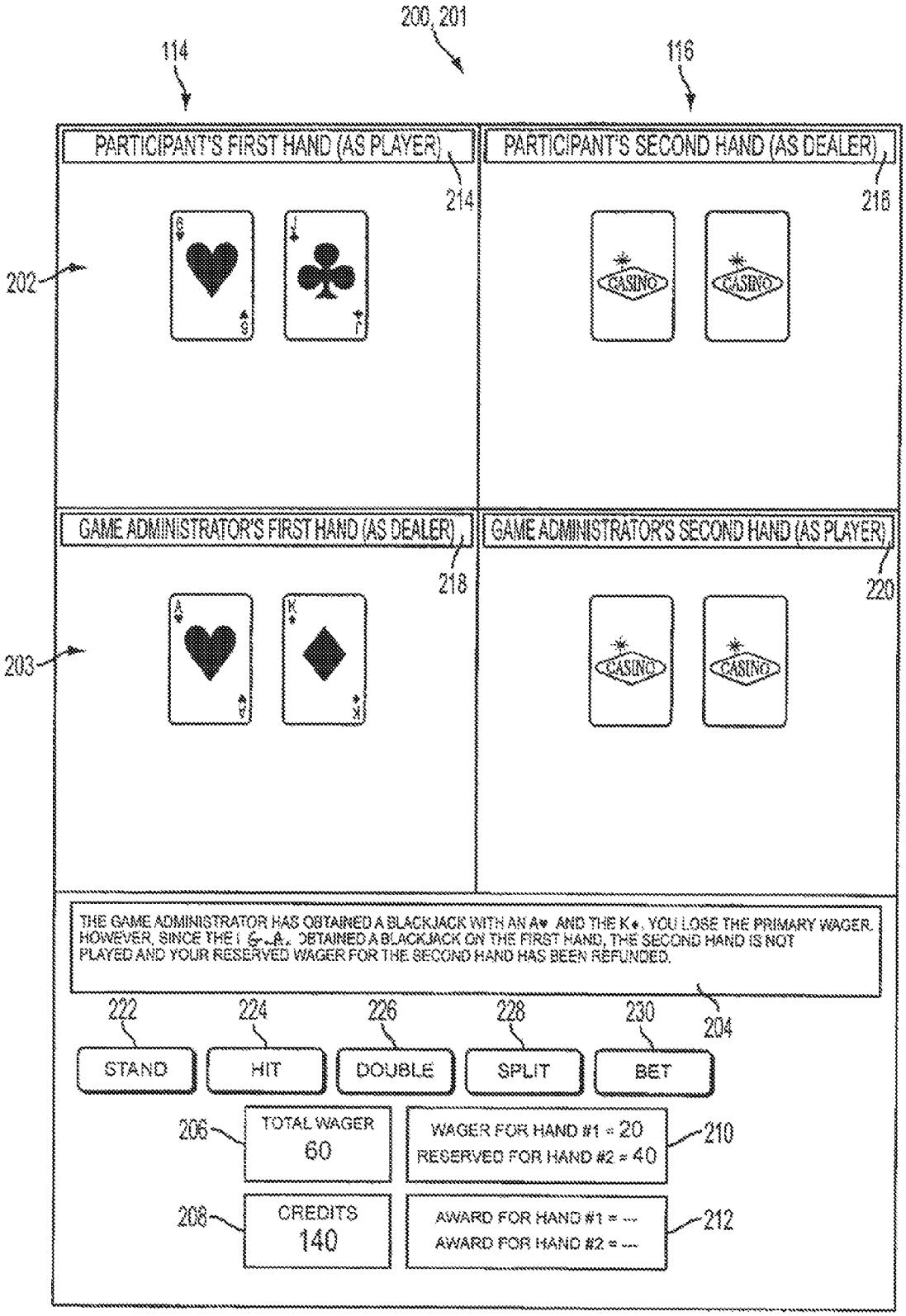
FIG. 14 is a top view of an example second play of one embodiment of the Blackjack game, where the first game administrator hand is a Blackjack.

In the example illustrated in FIG. 14, the first game administrator hand 218 is a Blackjack. As mentioned above, this prevents the participant from wagering additional moneys or credits on the first participant hand 214 if there is no chance for the participant to win. As indicated by the message display 218, the game administrator has a Blackjack in this first round 114 of play. At this stage, the participant has lost the first round 114. Also, in this embodiment, because the first game administrator hand 218 was a Blackjack, the second round 116 is not played. Moreover, the participant is refunded the amount reserved for the second round 116 (i.e., forty credits), as indicated in the general message area 204 and the award display 212. In one embodiment, a processor causes the value of the credits area 208 to be increased to 130 to reflect the refund of the wager amount reserved for the second round 116.

An example method of operating one embodiment of game 200 involves the initial step of the participant making an initial bet or wager for the participant's hand. Additionally, the participant must have sufficient chips, checks, money or other suitable assets to cover possible losses on the participant's banker hand. The game administrator must place a matching bet to play against the participant. Once the bets are placed, the participant and the game administrator each receive four cards. The cards are dealt face down. However, the participant is able to view the participant's cards, which are not visible to the game administrator. The participant separates the four participant cards into a two-card first participant hand and a two-card second participant hand. Similarly, the game administrator separates the four game administrator cards into a two-card first game administrator hand and a two-card second game administrator hand. The first round 114 is played out in normal Blackjack fashion wherein the participant plays against the game administrator. The second round 116 is played out with the game administrator acting as player and the participant acting as the dealer.

Once the participant and the game administrator have set their two, two-card hands, the participant and game administrator both reveal their dealer face-up cards and play commences with the first round. In one embodiment, the game administrator and participant decide which card to declare as the face-up cards. In another embodiment, the face-up card to be displayed is randomly selected by a separate random process or device from the participant's two-card dealer hand and from the game administrator's two-card dealer hand.

In one embodiment, if a given participant's or game administrator's initial four cards contain at least one card having a ten value (e.g., 10, Jack, Queen, or King) and one Ace, the participant and game administrator are required to combine them in the first hand to form a Blackjack.

In another embodiment, selection rules require the participant to form a stronger first participant hand relative to the second participant hand according to a definition of starting hand strength. In one example of a definition of starting hand strength, a hand having a value of twenty has a higher starting hand strength than a hand having a value of seventeen. In this example, it is more likely that a participant hand having a value of twenty will beat the game administrator hand.

In an embodiment, the system enables the participant and the game administrator to view their respective initial set of cards, where the set of cards includes at least four cards. In this embodiment, the participant selects two cards to be used in the first participant hand and two cards to be used in the second participant hand. Similarly, the game administrator selects two cards from the initial set of game administrator cards to use in the first game administrator hand and the second game administrator hand. Any remaining cards are eliminated from further play in the game. Therefore, the cards for the participant hands and the game administrator hands are set. However, the face-up cards in both the game administrator first hand and the participant second hand have not been determined. In one embodiment, the system randomly determines one of the cards in the game administrator first hand and one of the cards in the participant second hand to be the face-up cards. In another embodiment, the participant selects one of the cards in the participant second hand to be the face-up card. Similarly, in this embodiment, the game administrator selects one of the two cards in the first game administrator hand to be the face-up card.

In one embodiment, the system enables the participant and the game administrator to view their initial four cards and select one card to be used as the face-up card prior to setting the first and second hands. That is, the participant must select one card to be the face-up card in the second participant hand (i.e., where the participant plays the role of the dealer), and the game administrator must select one card to be the face-up card in the first game administrator hand. Both of these face-up cards for the participant and the game administrator are revealed prior to the participant and the game administrator selecting the remaining cards to use in their first and second hands. That is, the participant is able to take into account the game administrator's face-up card in the first game administrator hand when determining which cards to designate or select for the first participant hand and the second participant hand. Similarly, the game administrator is able to take into consideration the value of the face-up card in the second participant hand when determining which cards to designate or select for the first game administrator hand and the second game administrator hand. Accordingly, both the participant and the game administrator can strategically determine not only the cards that they would like to use in each of their hands, but also can determine which card they want to initially reveal to their opponent. That is, in the second participant hand, one card is visible to the game administrator and one is not. This is similar to the first game administrator hand, where one of the game administrator cards is not visible to the participant.

In one embodiment, the game administrator is able to set the game administrator's hand after viewing the participant's second hand face-up card. In this embodiment, the game administrator has a distinct advantage in acting last.

In one embodiment, the game administrator deals more than four cards to the participant and the game administrator to form the initial set of participant cards and game administrator cards. In this embodiment, the participant and the game administrator choose the best or desired four cards to use as cards in the first round and the second round. The remaining cards are discarded. It should be appreciated that the number of cards initially dealt to the participant and game administrator may be five, six, or any suitable number. In another embodiment, the number of cards initially dealt to the participant may be more than the number of cards initially dealt to the game administrator. This gives the participant an advantage in having a larger pool of cards to draw from than the game administrator.

In one embodiment, if the game administrator holds a Blackjack in the first round 114, then the second round 116 is not played out. In another embodiment, if the casino holds a Blackjack in the first round 114, the second round 116 is not played out unless the participant also holds a Blackjack in the participant's first hand.

In one embodiment, the first hand and the second hand (if played) must be played under identical rules. In another embodiment, the first hand plays under a first set of rules and the second hand plays under a second set of rules. For example, the game administrator on the first hand may be required to hit on a soft-17 while on the second hand, the participant as dealer may be required to stay on a soft-17. In another example, to reduce the participant's bank liability, the participant is allowed to double-down after splitting while not allowing the game administrator as a participant to do so. In one embodiment, a game may allow a participant to elect to not play a second round after the participant has seen the participant's initial four cards but before the first round has been started. This decision by the participant must be made before the game administrator can select a first hand of cards. If the participant elects to play the second round, outcomes of the first round and the second round are determined according to the player rules 104 and the dealer rules 106.

In an embodiment, the initial set of participant cards includes three cards, and the initial set of game administrator cards includes three cards. The participant selects two cards from the initial set of participant cards for use in the first participant hand and selects one card for use in the second participant hand, and the game administrator selects two cards from the initial set of game administrator cards for use in the second game administrator hand and selects one card for use in the first game administrator hand. In this embodiment, the modified Blackjack game is played according to conventional European Blackjack rules, wherein the first game administrator hand receives a second card after the first participant hand has been modified according to the player rules. Similarly, the second participant hand receives a second card after the second game administrator hand has been modified according to player rules.

As described above, in an embodiment, the modified Blackjack game 200 is played as a table game. In this embodiment, a multi-participant gaming table is provided and the game is played with a human game administrator. In this embodiment, each participant places a wager and plays two hands, one as a participant and the second as a dealer. The table may include two play areas for each participant position, where the first hand is played in the first play area and the second hand is played in the second play area. Likewise, the game administrator would have a second play area for the second game administrator hand. Because there are multiple participants playing as the dealer, the live game administrator would play the second game administrator hand, acting as the player, after the conclusion of the first hand. Therefore, because the game administrator, acting as the player, plays the second game administrator hand before the participants play the second participant hand, the participants are the last to act. This is a modification to the conventional Blackjack live table games, where the game administrator is always the last to act. After each of the participants have played their second participant hands, the live game administrator pays out any awards accordingly.

As discussed above, in one embodiment, the modified Blackjack game 200 is a card game played at a gaming table with a live game administrator and one or more conventional decks of fifty-two playing cards. In an embodiment, the gaming table may include suitable monitoring, scanning or reading devices that are capable of identifying the values of the game administrator's and participant's cards. In one embodiment, the card reading device includes a processor under control of a computer-based tracking program. In one example, an optical reader is included in a card shoe, and the computer tracking program is executable to determine the number of cards dealt and at least partially determine what cards have been dealt to the different participants and the game administrator, based in part, on the rules of the game. The card reading device may be optical, based on radio frequency identification or any other suitable card identification system.

In an embodiment, the gaming table includes a card reading identification device, as discussed above. In this embodiment, such device identifies and stores into a memory the values of all of the cards that have been dealt to the participant and the game administrator. In another embodiment, the card reader selectively identifies only the game administrator cards (face-up or face-down), and the participant cards that have been dealt face-up or otherwise revealed through the course of play of the game. The card reading device uses the information of the values of the cards in the participant hands and game administrator hands to determine optimal casino play strategy. Then, the processor of the card reader causes an image, message or other indication to be communicated to the game administrator to direct the game administrator's next action (i.e., hitting, standing, splitting, or doubling-down). This can be particularly important in the second game administrator hand, where the game administrator is playing the role of the player according to player rules, where player rules can be more liberal than dealer rules with regard to play options. That is, in the player role, the participant must consider the game administrator's up-card and the participant's cards in determining the optimal strategy for the participant's hand. In contrast, the dealer rules can be more restrictive and require hitting until a minimum hand value is reached, and then prevent further hitting after this amount has been reached.

Employing such a card reading system in the table game enables the gaming device to track the revealed cards in the modified Blackjack game and provide strategic information to the game administrator while decreasing additional work or distractions for the game administrator. This tracking information can alleviate the game administrator from having to thoughtfully consider and apply optimal Blackjack strategy with regard to at least the second game administrator hand.

It should be appreciated that although several examples illustrating player-dealer role reversal are described above with reference to a modified Blackjack game, in other embodiments, the concept of player-dealer role reversal can be applied to different card games. For example, in one embodiment, a multiple hand Three Card Poker game is provided where a first round is played out in a conventional manner, with the participant playing as the player. Then, a second Three Card Poker round is played with the game administrator acting as the player and the participant acting as the dealer. In one embodiment, the game 200 includes more than two card rounds. In another embodiment, the game 200 involves multiple participants and multiple game administrators.

Electronic Gaming Device Embodiments

In one embodiment, some or all of the elements of the game system 100 and game 200 described above (collectively referred to as "modified Blackjack elements") have a video, simulated, animated or virtual form, where such elements are formed by computerized graphical representations of actual physical objects. In such embodiment, the modified Blackjack elements may be implemented in various configurations for gaming machines or gaming devices, including, but not limited to: (1) a dedicated gaming machine or gaming device, wherein the computerized instructions for controlling any games (which are provided by the gaming machine or gaming device) are provided with the gaming machine or gaming device prior to delivery to a gaming establishment; and (2) a changeable gaming machine or gaming device, where the computerized instructions for controlling any games (which are provided by the gaming machine or gaming device) are downloadable to the gaming machine or gaming device through a data network when the gaming machine or gaming device is in a gaming establishment. In one embodiment, the computerized instructions for controlling any games are executed by a central server, central controller or remote host. In such a "thin client" embodiment, the central server remotely controls any games (or other suitable interfaces) and the gaming device is utilized to display such games (or suitable interfaces) and receive one or more inputs or commands from a participant. In another embodiment, the computerized instructions for controlling any games are communicated from the central server, central controller or remote host to a gaming device local processor and memory devices. In such a "thick client" embodiment, the gaming device local processor executes the communicated computerized instructions to control any games (or other suitable interfaces) provided to a participant.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

It should be appreciated that other embodiments of the modified Blackjack elements can be played remotely from the gaming establishment, such as games played on a personal computer, personal digital assistant (PDA), cellular phone, or other internet access device. In these embodiments; the user installs a program on the computer or other digital device and is able to play the game remotely. Alternatively, the participant is not required to install a program and may simply play the game over or through the internet or other network by accessing one or more online applications of the gaming system using a suitable internet access device.

Figure 15A:
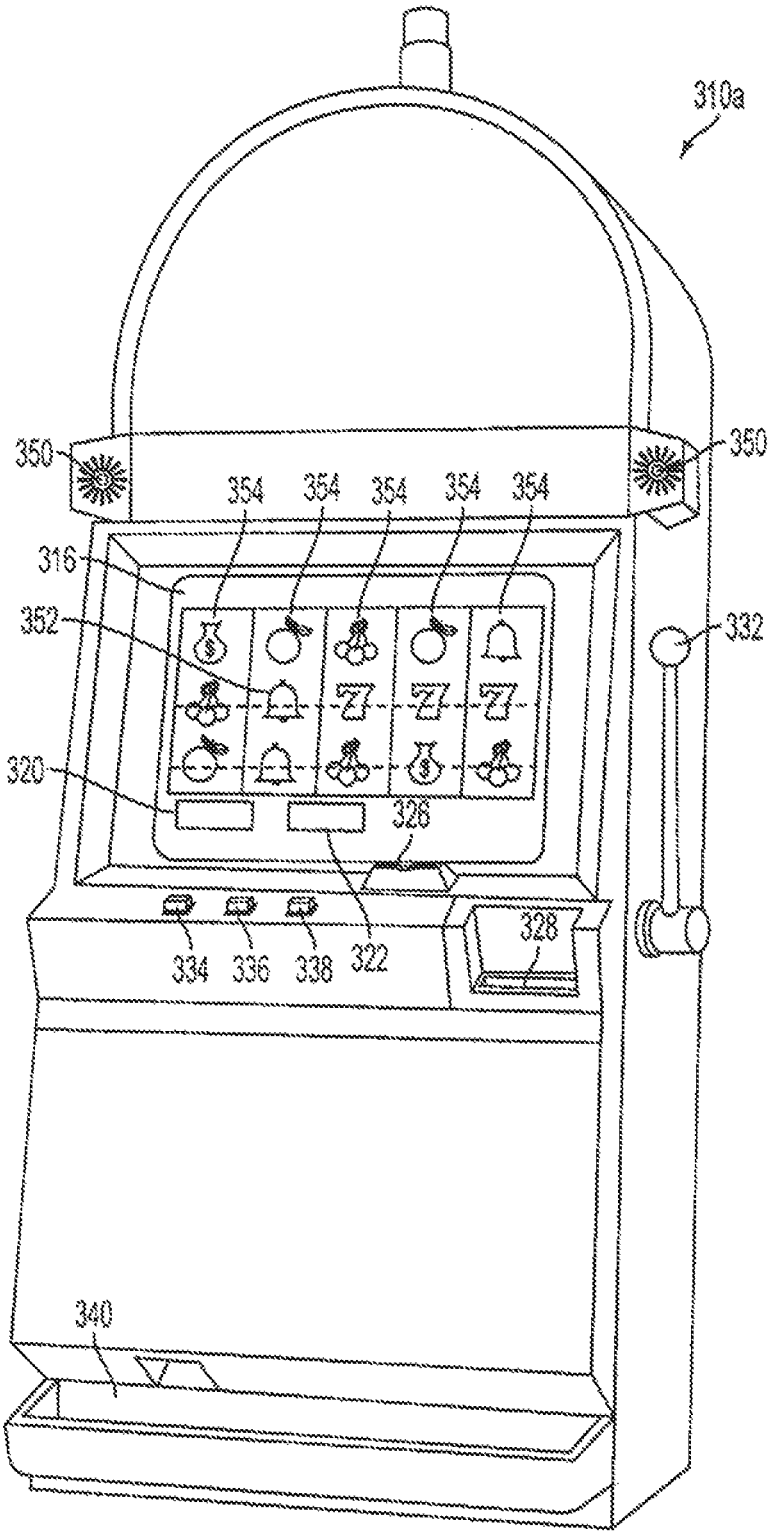
FIG. 15A is a front perspective view of one embodiment of the gaming device, where the primary game is a slot game.
Figure 15B:
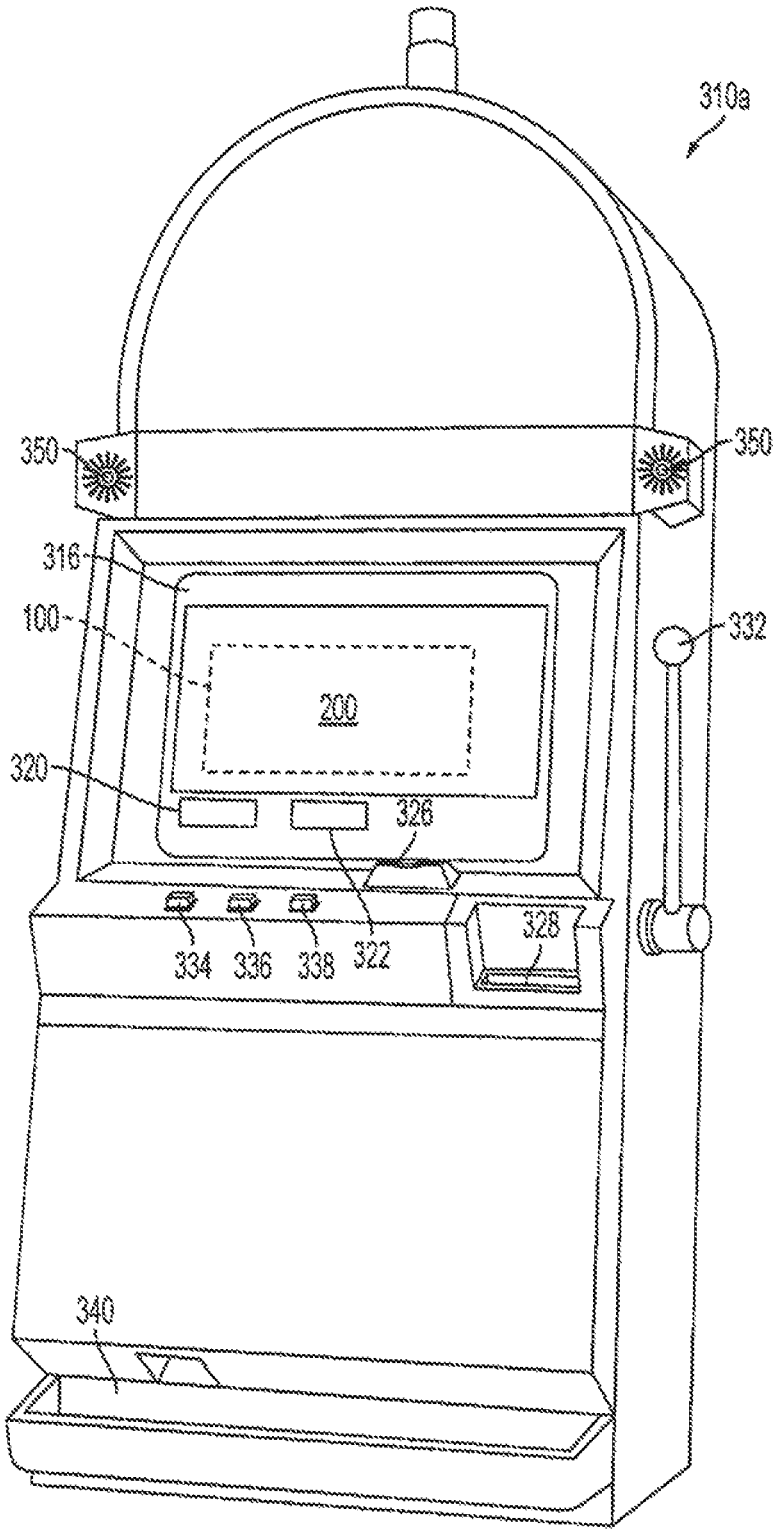
FIG. 15B is a front perspective view of one embodiment of the gaming device, where the primary game is a modified Blackjack game.
Figure 16:
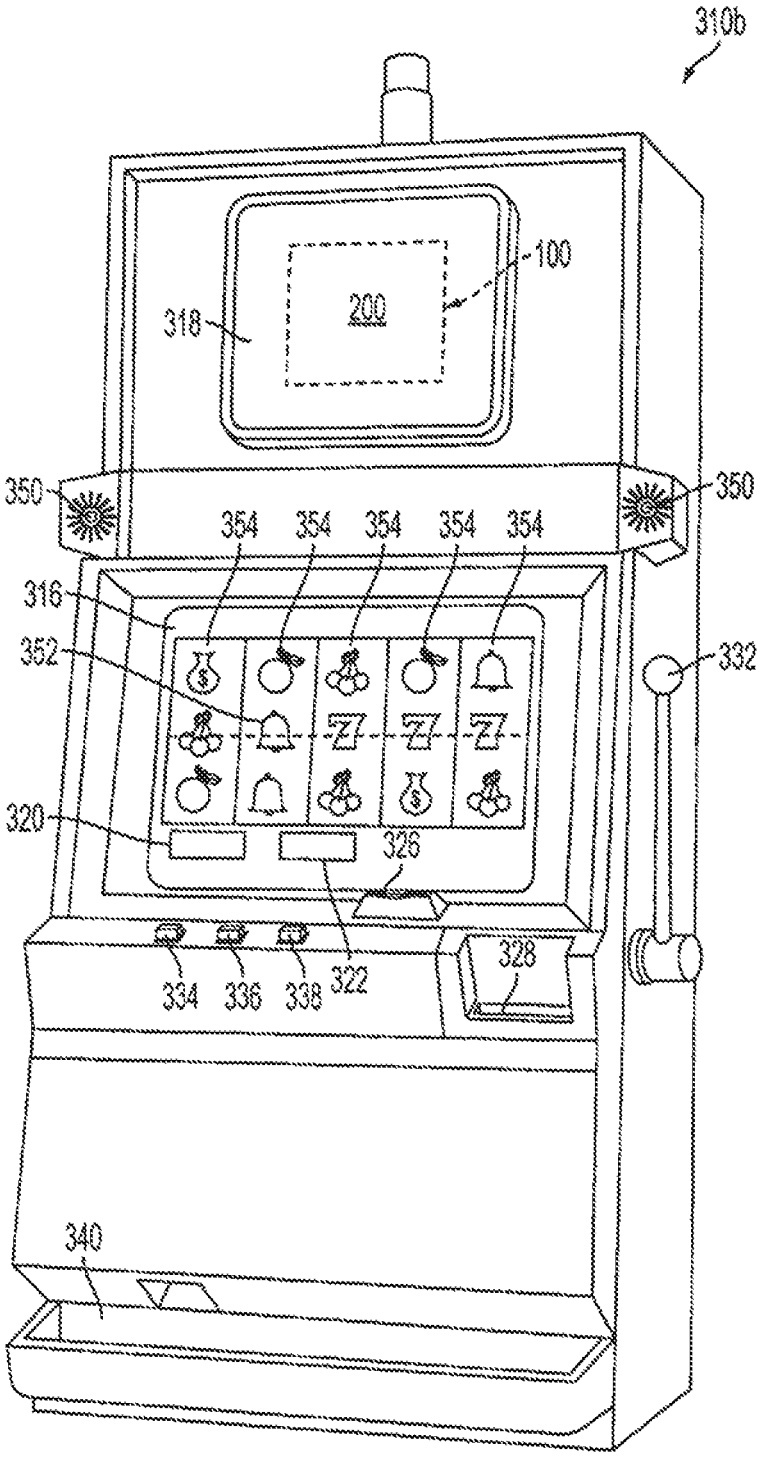
FIG. 16 is a front perspective view of another embodiment of the gaming device, where the secondary game is a modified Blackjack game.

Two example alternative embodiments of a gaming device which implements the modified Blackjack elements are illustrated in FIGS. 15A, 15B and 16 as gaming device 310*a* and gaming device 310*b*, respectively. Gaming device 310*a* and/or gaming device 310*b* are generally referred to herein as gaming device 310.

In the embodiments illustrated in FIGS. 15A, 15B and 16, gaming device 310 has a support structure, housing or cabinet which provides support for a plurality of displays, inputs, controls and other features of a conventional gaming machine. It is configured so that a participant can operate it while standing or sitting. The gaming device may be positioned on a base or stand or can be configured as a pub-style table-top game (not shown) which a participant can operate preferably while sitting. As illustrated by the different configurations shown in FIGS. 15A, 15B and 16, the gaming device may have varying cabinet and display configurations.

Figure 17:
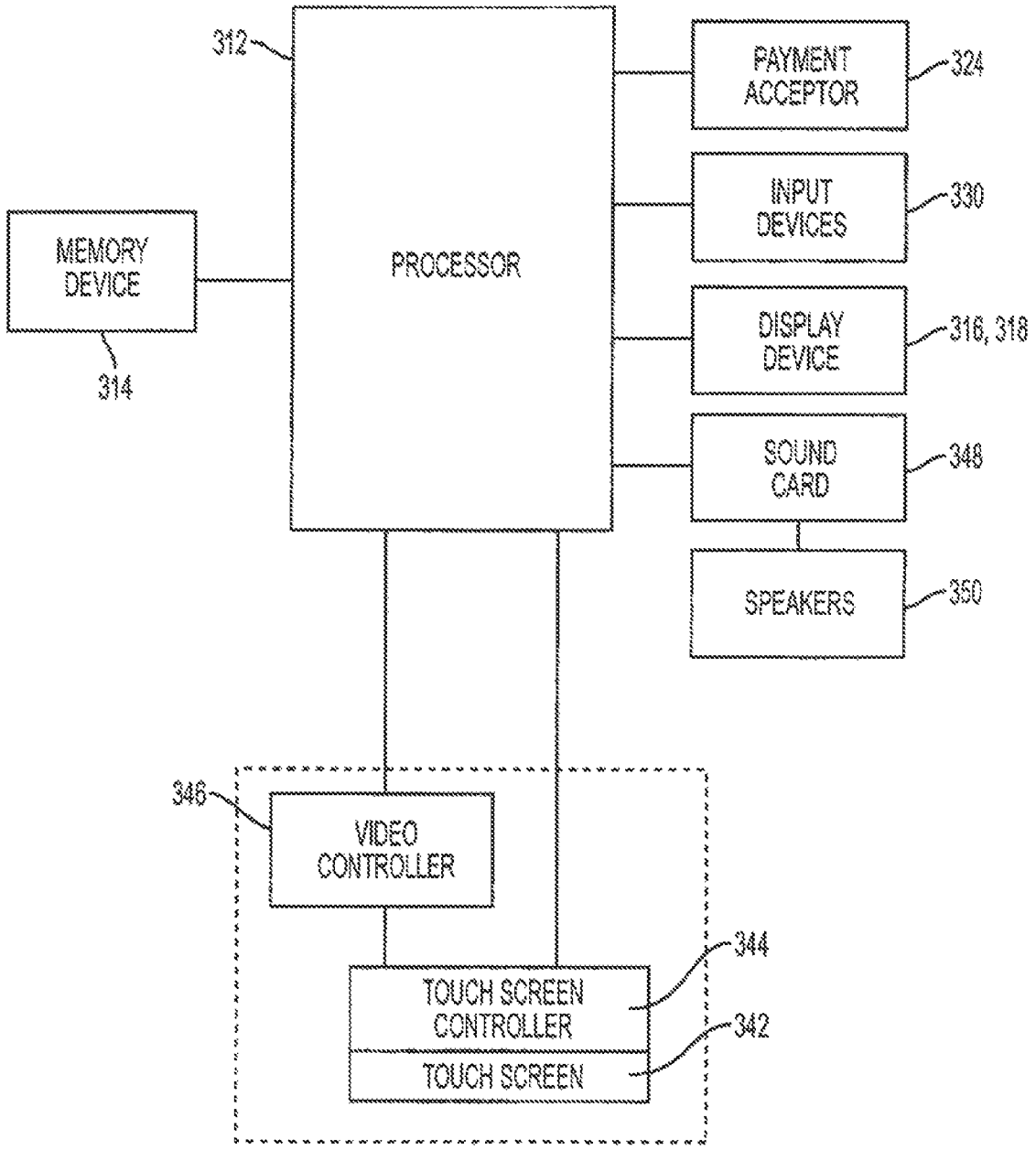
FIG. 17 is a schematic view of another electronic configuration of one embodiment of the gaming device.

In one embodiment, as illustrated in FIG. 17, the gaming device preferably includes at least one processor 312, such as a microprocessor, a microcontroller-based platform, a suitable integrated circuit or one or more application-specific integrated circuits (ASIC's). The processor is in communication with or operable to access or to exchange signals with at least one data storage or memory device 314. In one embodiment, the processor and the memory device reside within the cabinet of the gaming device. The memory device stores program code and instructions, executable by the processor, to control the gaming device. The memory device also stores other data such as image data, event data, participant input data, random or pseudo-random number generators, paytable data or information and applicable game rules that relate to the play of the gaming device, and stores computer-readable rules, data and instructions of the gaming system 100 (see also, FIG. 1). In one embodiment, the memory device includes random access memory (RAM), which can include non-volatile RAM (NVRAM), magnetic RAM (MRAM), ferroelectric RAM (FeRAM) and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD or USB memory device. In other embodiments, part or all of the program code and/or operating data described above can be downloaded to the memory device through a suitable network.

In one embodiment, an operator or a participant can use such a removable memory device in a desktop computer, a laptop personal computer, a personal digital assistant (PDA), portable computing device, or other computerized platform to implement the present disclosure. In one embodiment, the gaming device or gaming machine disclosed herein is operable over a wireless network, such as part of a wireless gaming system. In this embodiment, the gaming machine may be a hand held device, a mobile device or any other suitable wireless device that enables a participant to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator or other suitable randomization process. In one embodiment, each award or other game outcome is associated with a probability and the gaming device generates the award or other game outcome to be provided to the participant based on the associated probabilities. In this embodiment, since the gaming device generates outcomes randomly or based upon one or more probability calculations, there is no certainty that the gaming device will ever provide the participant with any specific award or other game outcome.

In another embodiment, as discussed in more detail below, the gaming device employs a predetermined or finite set or pool of awards or other game outcomes. In this embodiment, as each award or other game outcome is provided to the participant, the gaming device flags or removes the provided award or other game outcome from the predetermined set or pool. Once flagged or removed from the set or pool, the specific provided award or other game outcome from that specific pool cannot be provided to the participant again. This type of gaming device provides participants with all of the available awards or other game outcomes over the course of the play cycle and guarantees the amount of actual wins and losses.

In another embodiment, as discussed below, upon a participant initiating game play at the gaming device, the gaming device enrolls in a bingo game. In this embodiment, a bingo server calls the bingo balls that result in a specific bingo game outcome. The resultant game outcome is communicated to the individual gaming device to be provided to a participant. In one embodiment, this bingo outcome is displayed to the participant as a bingo game and/or in any form in accordance with the present disclosure.

In one embodiment, as illustrated in FIG. 17, the gaming device includes one or more display devices controlled by the processor. The display devices are preferably connected to or mounted to the cabinet of the gaming device. The embodiment shown in FIG. 15 includes a central display device 316 which displays a primary game. This display device may also display any suitable secondary game associated with the primary game as well as information relating to the primary or secondary game. The alternative embodiment shown in FIG. 16 includes a central display device 316 and an upper display device 318. The upper display device may display the primary game, any suitable secondary game associated or not associated with the primary game and/or information relating to the primary or secondary game. These display devices may also serve as digital glass operable to advertise games or other aspects of the gaming establishment. As seen in FIGS. 15A, 15B and 16, in one embodiment, the gaming device includes a credit display 320 which displays a participant's current number of credits, cash, account balance or the equivalent. In one embodiment, gaming device includes a bet display 322 which displays a participant's amount wagered.

In another embodiment, at least one display device may be a mobile display device, such as a PDA or tablet PC, that enables play of at least a portion of the primary or secondary game at a location remote from the gaming device.

The display devices may include, without limitation, a monitor, a television display, a plasma display, a liquid crystal display (LCD) a display based on light emitting diodes (LED), a display based on a plurality of organic light-emitting diodes (OLEDs), a display based on polymer light-emitting diodes (PLEDs), a display based on a plurality of surface-conduction electron-emitters (SEDs), a display including a projected and/or reflected image or any other suitable electronic device or display mechanism. In one embodiment, as described in more detail below, the display device includes a touch-screen with an associated touch-screen controller. The display devices may be of any suitable size and configuration, such as a square, a rectangle or an elongated rectangle.

The display devices of the gaming device are configured to display at least one and preferably a plurality of game or other suitable images, symbols and indicia such as any visual representation or exhibition of the movement of objects such as mechanical, virtual or video reels and wheels, dynamic lighting, video images, images of people, characters, places, things and faces of cards, and the like.

In one alternative embodiment, the symbols, images and indicia displayed on or of the display device may be in mechanical form. That is, the display device may include any electromechanical device, such as one or more mechanical objects, such as one or more rotatable wheels, reels or dice, configured to display at least one or a plurality of game or other suitable images, symbols or indicia.

As illustrated in FIG. 17, in one embodiment, the gaming device includes at least one payment acceptor 324 in communication with the processor. As seen in FIGS. 15A, 15B and 16, the payment acceptor may include a coin slot 326 and a payment, note or bill acceptor 328, where the participant inserts money, coins or tokens. The participant can place coins in the coin slot or paper money, a ticket or voucher into the payment, note or bill acceptor. In other embodiments, devices such as readers or validators for credit cards, debit cards or credit slips may accept payment. In one embodiment, a participant may insert an identification card into a card reader of the gaming device. In one embodiment, the identification card is a smart card having a programmed microchip or a magnetic strip coded with a participant's identification, credit totals (or related data) and other relevant information. In another embodiment, a participant may carry a portable device, such as a cell phone, a radio frequency identification tag or any other suitable wireless device, which communicates a participant's identification, credit totals (or related data) and other relevant information to the gaming device. In one embodiment, money may be transferred to a gaming device through electronic funds transfer. When a participant funds the gaming device, the processor determines the amount of funds entered and displays the corresponding amount on the credit or other suitable display as described above.

As seen in FIGS. 15A, 15B, 16 and 17, in one embodiment the gaming device includes at least one and preferably a plurality of input devices 330 in communication with the processor. The input devices can include any suitable device which enables the participant to produce an input signal which is received by the processor. In one embodiment, after appropriate funding of the gaming device, the input device is a game activation device, such as a pull arm 332 or a play button 334 which is used by the participant to start any primary game or sequence of events in the gaming device. The play button can be any suitable play activator such as a bet one button, a max bet button or a repeat the bet button. In one embodiment, upon appropriate funding, the gaming device begins the game play automatically. In another embodiment, upon the participant engaging one of the play buttons, the gaming device automatically activates game play.

In one embodiment, as shown in FIGS. 15A, 15B and 16, one input device is a bet one button 336. The participant places a bet by pushing the bet one button. The participant can increase the bet by one credit each time the participant pushes the bet one button. When the participant pushes the bet one button, the number of credits shown in the credit display preferably decreases by one, and the number of credits shown in the bet display preferably increases by one. In another embodiment, one input device is a bet max button (not shown) which enables the participant to bet the maximum wager permitted for a game of the gaming device.

In one embodiment, one input device is a cash out button 338. The participant may push the cash out button and cash out to receive a cash payment or other suitable form of payment corresponding to the number of remaining credits. In one embodiment, when the participant cashes out, the participant receives the coins or tokens in a coin payout tray 340. In one embodiment, when the participant cashes out, the participant may receive other payout mechanisms such as tickets or credit slips redeemable by a cashier (or other suitable redemption system) or funding to the participant's electronically recordable identification card.

In one embodiment, as mentioned above and seen in FIG. 17, one input device is a touch-screen 342 coupled with a touch-screen controller 344, or some other touch-sensitive display overlay to allow for participant interaction with the images on the display. The touch-screen and the touch-screen controller are connected to a video controller 346. A participant can make decisions and input signals into the gaming device by touching the touch-screen at the appropriate places. One such input device is a conventional touch-screen button panel.

The gaming device may further include a plurality of communication ports for enabling communication of the processor with external peripherals, such as external video sources, expansion buses, game or other displays, an SCSI port or a key pad.

In one embodiment, as seen in FIG. 17, the gaming device includes a sound generating device controlled by one or more sounds cards 348 which function in conjunction with the processor. In one embodiment, the sound generating device includes at least one and preferably a plurality of speakers 350 or other sound generating hardware and/or software for generating sounds, such as playing music for the primary and/or secondary game or for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract participants to the gaming device. During idle periods, the gaming device may display a sequence of audio and/or visual attraction messages to attract potential participants to the gaming device. The videos may also be customized for or to provide any appropriate information.

In one embodiment, the gaming machine may include a sensor, such as a camera in communication with the processor (and possibly controlled by the processor) that is selectively positioned to acquire an image of a participant actively using the gaming device and/or the surrounding area of the gaming device. In one embodiment, the camera may be configured to selectively acquire still or moving (e.g., video) images and may be configured to acquire the images in either an analog, digital or other suitable format. The display devices may be configured to display the image acquired by the camera as well as display the visible manifestation of the game in split screen or picture-in-picture fashion. For example, the camera may acquire an image of the participant and the processor may incorporate that image into the primary and/or secondary game as a game image, symbol or indicia.

In addition to incorporating the game system elements for the system 200 and the related bonus sequence, gaming device 310 can incorporate any ancillary wagering game. The ancillary wagering game can be incorporated into the primary wheel game described above, the bonus sequence described above or a combination thereof. The gaming machine or device may include some or all of the features of conventional gaming machines or devices. The ancillary game may comprise any suitable reel-type game, a card game (other than game 200), a cascading or falling symbol game, a number game or any other game of chance susceptible to representation in an electronic or electromechanical form, which in one embodiment produces a random outcome based on probability data at the time of or after placement of a wager. That is, different wagering games, such as video poker games, video keno, video bingo or any other suitable game may be implemented.

As illustrated in FIG. 15A, in one embodiment, the primary game of gaming device 310*a* is a slot game. Upon the occurrence of a suitable bonus trigger in such primary game, the gaming device 310*a* displays the game 200 illustrated in FIG. 15B. Gaming device 310*b* illustrated in FIG. 16 displays a primary slot game at lower display 316 and game 200 at upper display 318. In either embodiment, the primary slot games illustrated in FIGS. 15A and 16 may be any suitable slot game with one or more paylines 352. The paylines may be horizontal, vertical, circular, diagonal, angled or any combination thereof. In this embodiment, the gaming device includes at least one and preferably a plurality of reels 354, such as three to five reels 354, in either electromechanical form with mechanical rotating reels or video form with simulated reels and movement thereof. In one embodiment, an electromechanical slot machine includes a plurality of adjacent, rotatable reels which may be combined and operably coupled with an electronic display of any suitable type. In another embodiment, if the reels 354 are in video form, one or more of the display devices, as described above, display the plurality of simulated video reels 354. Each reel 354 displays a plurality of indicia or symbols, such as bells, hearts, fruits, numbers, letters, bars or other images which preferably correspond to a theme associated with the gaming device. In another embodiment, one or more of the reels are independent reels or unisymbol reels. In this embodiment, each independent or unisymbol reel generates and displays one symbol to the participant. In one embodiment, the gaming device awards prizes after the reels of the ancillary wagering game stop spinning if specified types and/or configurations of indicia or symbols occur on an active payline or otherwise occur in a winning pattern, occur on the requisite number of adjacent reels and/or occur in a scatter pay arrangement.

In an alternative embodiment, rather than determining any outcome to provide to the participant by analyzing the symbols generated on any wagered upon paylines as described above, the gaming device determines any outcome to provide to the participant based on the number of associated symbols which are generated in active symbol positions on the requisite number of adjacent reels (i.e., not on paylines passing through any displayed winning symbol combinations). In this embodiment, if a winning symbol combination is generated on the reels, the gaming device provides the participant one award for that occurrence of the generated winning symbol combination. For example, if one winning symbol combination is generated on the reels, the gaming device will provide a single award to the participant for that winning symbol combination (i.e., not based on the number of paylines that would have passed through that winning symbol combination). It should be appreciated that because a gaming device with wagering on ways to win provides the participant one award for a single occurrence of a winning symbol combination and a gaming device with paylines may provide the participant more than one award for the same occurrence of a single winning symbol combination (i.e., if a plurality of paylines each pass through the same winning symbol combination); it is possible to provide a participant with more ways to win for an equivalent bet or wager on a conventional slot gaming device with paylines.

In one embodiment, the total number of ways to win is determined by multiplying the number of symbols generated in active symbol positions on a first reel by the number of symbols generated in active symbol positions on a second reel by the number of symbols generated in active symbol positions on a third reel and so on for each reel of the gaming device with at least one symbol generated in an active symbol position. For example, a three reel gaming device with three symbols generated in active symbol positions on each reel includes 27 ways to win (i.e., 3 symbols on the first reel×3 symbols on the second reel×3 symbols on the third reel). A four reel gaming device with three symbols generated in active symbol positions on each reel includes 81 ways to win (i.e., 3 symbols on the first reel×3 symbols on the second reel×3 symbols on the third reel×3 symbols on the fourth reel). A five reel gaming device with three symbols generated in active symbol positions on each reel includes 243 ways to win (i.e., 3 symbols on the first reel×3 symbols on the second reel×3 symbols on the third reel×3 symbols on the fourth reel×3 symbols on the fifth reel). It should be appreciated that modifying the number of generated symbols by either modifying the number of reels or modifying the number of symbols generated in active symbol positions by one or more of the reels, modifies the number of ways to win.

In another embodiment, the gaming device enables a participant to wager on and thus activate symbol positions. In one such embodiment, the symbol positions are on the reels. In this embodiment, if based on the participant's wager, a reel is activated, then each of the symbol positions of that reel will be activated and each of the active symbol positions will be part of one or more of the ways to win. In one embodiment, if based on the participant's wager, a reel is not activated, then a designated number of default symbol positions, such as a single symbol position of the middle row of the reel, will be activated and the default symbol position(s) will be part of one or more of the ways to win. This type of gaming machine enables a participant to wager on one, more or each of the reels and the processor of the gaming device uses the number of wagered on reels to determine the active symbol positions and the number of possible ways to win. In alternative embodiments, (1) no symbols are displayed as generated at any of the inactive symbol positions, or (2) any symbols generated at any inactive symbol positions may be displayed to the participant but suitably shaded or otherwise designated as inactive.

In one embodiment wherein a participant wagers on one or more reels, a participant's wager of one credit may activate each of the three symbol positions on a first reel, wherein one default symbol position is activated on each of the remaining four reels. In this example, as described above, the gaming device provides the participant three ways to win (i.e., 3 symbols on the first reel×1 symbol on the second reel×1 symbol on the third reel×1 symbol on the fourth reel×1 symbol on the fifth reel). In another example, a participant's wager of nine credits may activate each of the three symbol positions on a first reel, each of the three symbol positions on a second reel and each of the three symbol positions on a third reel wherein one default symbol position is activated on each of the remaining two reels. In this example, as described above, the gaming device provides the participant twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the participant based on the generated symbols, the gaming device individually determines if a symbol generated in an active symbol position on a first reel forms part of a winning symbol combination with or is otherwise suitably related to a symbol generated in an active symbol position on a second reel. In this embodiment, the gaming device classifies each pair of symbols which form part of a winning symbol combination (i.e., each pair of related symbols) as a string of related symbols. For example, if active symbol positions include a first cherry symbol generated in the top row of a first reel and a second cherry symbol generated in the bottom row of a second reel, the gaming device classifies the two cherry symbols as a string of related symbols because the two cherry symbols form part of a winning symbol combination.

After determining if any strings of related symbols are formed between the symbols on the first reel and the symbols on the second reel, the gaming device determines if any of the symbols from the next adjacent reel should be added to any of the formed strings of related symbols. In this embodiment, for a first of the classified strings of related symbols, the gaming device determines if any of the symbols generated by the next adjacent reel form part of a winning symbol combination or are otherwise related to the symbols of the first string of related symbols. If the gaming device determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the gaming device adds the related cherry symbol generated on the third reel to the previously classified string of cherry symbols.

On the other hand, if the gaming device determines that no symbols generated on the next adjacent reel are related to the symbols of the first string of related symbols, the gaming device marks or flags such string of related symbols as complete. For example, if the first string of related symbols is the string of related cherry symbols and none of the symbols of the third reel are related to the cherry symbols of the previously classified string of cherry symbols, the gaming device marks or flags the string of cherry symbols as complete.

After either adding a related symbol to the first string of related symbols or marking the first string of related symbols as complete, the gaming device proceeds as described above for each of the remaining classified strings of related symbols which were previously classified or formed from related symbols on the first and second reels.

After analyzing each of the remaining strings of related symbols, the gaming device determines, for each remaining pending or incomplete string of related symbols, if any of the symbols from the next adjacent reel, if any, should be added to any of the previously classified strings of related symbols. This process continues until either each string of related symbols is complete or there are no more adjacent reels of symbols to analyze. In this embodiment, where there are no more adjacent reels of symbols to analyze, the gaming device marks each of the remaining pending strings of related symbols as complete.

When each of the strings of related symbols is marked complete, the gaming device compares each of the strings of related symbols to an appropriate paytable and provides the participant any award associated with each of the completed strings of symbols. It should be appreciated that the participant is provided one award, if any, for each string of related symbols generated in active symbol positions (i.e., as opposed to being based on how many paylines that would have passed through each of the strings of related symbols in active symbol positions).

In one embodiment, the ancillary wagering game may be a poker game wherein the gaming device enables the participant to play a conventional game of video draw poker and initially deals five cards all face-up from a virtual deck of fifty-two card deck. Cards may be dealt as in a conventional game of cards or in the case of the gaming device, may also include that the cards are randomly selected from a predetermined number of cards. If the participant wishes to draw, the participant selects the cards to hold via one or more input device, such as pressing related hold buttons or via the touch screen. The participant then presses the deal button and the unwanted or discarded cards are removed from the display and the gaming machine deals the replacement cards from the remaining cards in the deck. This results in a final five-card hand. The gaming device compares the final five-card hand to a payout table which utilizes conventional poker hand rankings to determine the winning hands. The gaming device provides the participant with an award based on a winning hand and the credits the participant wagered.

In another embodiment, the ancillary wagering game may be a multi-hand version of video poker. In this embodiment, the gaming device deals the participant at least two hands of cards. In one such embodiment, the cards are the same cards. In one embodiment each hand of cards is associated with its own deck of cards. The participant chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand and awards are provided to the participant.

In one embodiment, the ancillary wagering game may be a keno game wherein the gaming device displays a plurality of selectable indicia or numbers on at least one of the display devices. In this embodiment, the participant selects at least one or a plurality of the selectable indicia or numbers via an input device such as the touch screen. The gaming device then displays a series of drawn numbers to determine an amount of matches, if any, between the participant's selected numbers and the gaming device's drawn numbers. The participant is provided an award based on the amount of matches, if any, based on the amount of determined matches and the number of numbers drawn.

In one embodiment, the game 200 includes a bonus sequence and may give participants the opportunity to win credits in an ancillary bonus or secondary game or ancillary bonus or secondary round. The ancillary bonus or secondary game enables the participant to obtain a prize or payout in addition to the prize or payout, if any, obtained from the base or primary game. Depending on the embodiment, the game 200 can be the base or primary game of the gaming device, or the game 200 could be the bonus game of the gaming device. In general, the ancillary bonus or secondary game produces a significantly higher level of participant excitement than the base or primary game because it provides a greater expectation of winning than the base or primary game and is accompanied with more attractive or unusual features than the base or primary game. In one embodiment, the ancillary bonus or secondary game may be any type of suitable game, either similar to or completely different from the base or primary game.

In one embodiment, the triggering event or qualifying condition may be a selected outcome in the primary game or a particular arrangement of one or more indicia on a display device in the primary game. In other embodiments, the triggering event or qualifying condition may be by exceeding a certain amount of game play (such as number of games, number of credits, amount of time), or reaching a specified number of points earned during game play.

In another embodiment, the gaming device processor 312 or central server 356 randomly provides the participant one or more plays of one or more ancillary secondary games. In one such embodiment, the gaming device does not provide any apparent reasons to the participant for qualifying to play a secondary or bonus game. In this embodiment, qualifying for a bonus game is not triggered by an event in or based specifically on any of the plays of any primary game. That is, the gaming device may simply qualify a participant to play an ancillary secondary game without any explanation or alternatively with simple explanations. In another embodiment, the gaming device (or central server) qualifies a participant for an ancillary secondary game at least partially based on a game triggered or symbol triggered event, such as at least partially based on the play of a primary game.

In one embodiment, the gaming device includes a program which will automatically begin a bonus round after the participant has achieved a triggering event or qualifying condition in the base or primary game. In another embodiment, after a participant has qualified for a bonus game, the participant may subsequently enhance his/her bonus game participation through continued play on the base or primary game. Thus, for each bonus qualifying event, such as a bonus symbol, that the participant obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the participant may redeem extra bonus wagering credits during the ancillary bonus game to extend play of the ancillary bonus game.

In one embodiment, no separate entry fee or buy in for an ancillary bonus game need be employed. That is, a participant may not purchase an entry into an ancillary bonus game, rather they must win or earn entry through play of the primary game thus, encouraging play of the primary game. In another embodiment, qualification of the ancillary bonus or secondary game is accomplished through a simple "buy in" by the participant, for example, if the participant has been unsuccessful at qualifying through other specified activities. In another embodiment, the participant must make a separate side-wager on the ancillary bonus game or wager a designated amount in the primary game to qualify for the ancillary secondary game. In this embodiment, the ancillary secondary game triggering event must occur and the side-wager (or designated primary game wager amount) must have been placed to trigger the ancillary secondary game.

Figure 18:
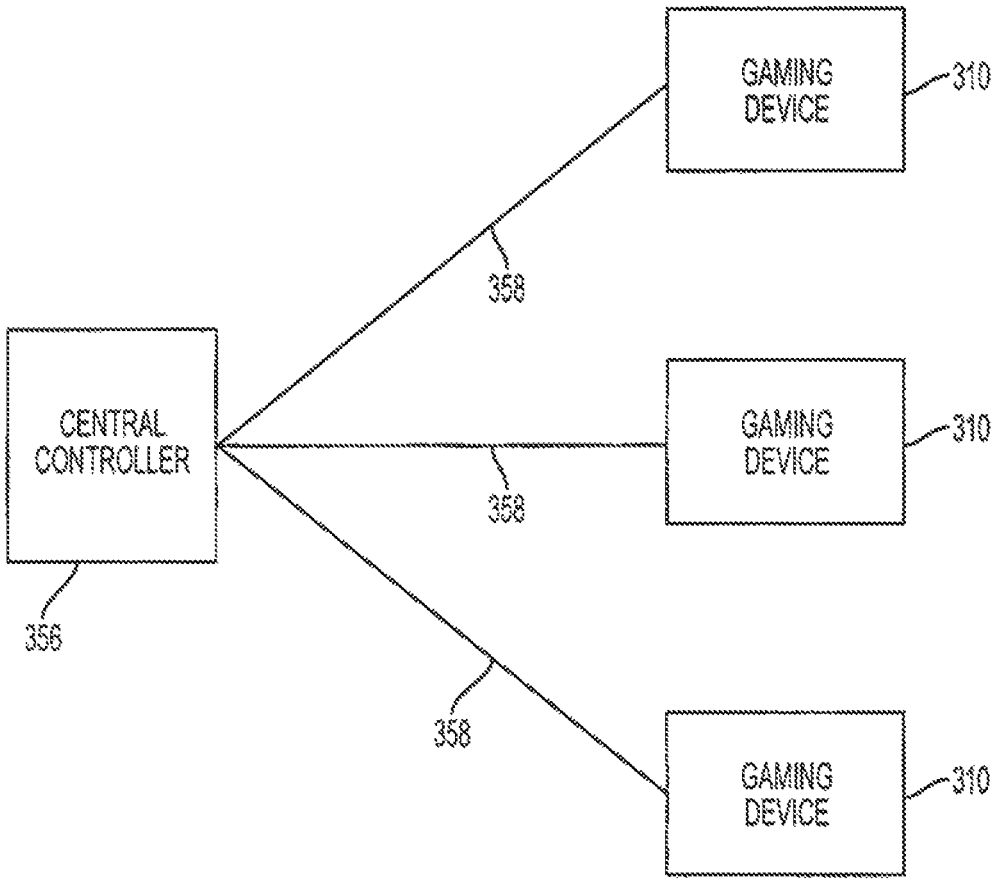
FIG. 18 is a schematic view of a central controller coupled to a plurality of embodiments of the gaming device.

In one embodiment, as illustrated in FIG. 18, one or more of the gaming devices 310 are in communication with each other and/or at least one central server, central controller or remote host 356 through a data network or remote communication link 358. In this embodiment, the central server, central controller or remote host is any suitable server or computing device which includes at least one processor and at least one memory or storage device. In different such embodiments, the central server is a progressive controller or a processor of one of the gaming devices in the gaming system. In these embodiments, the processor of each gaming device is designed to transmit and receive events, messages, commands or any other suitable data or signal between the individual gaming device and the central server. The gaming device processor is operable to execute such communicated events, messages or commands in conjunction with the operation of the gaming device. Moreover, the processor of the central server is designed to transmit and receive events, messages, commands or any other suitable data or signal between the central server and each of the individual gaming devices. The central server processor is operable to execute such communicated events, messages or commands in conjunction with the operation of the central server. It should be appreciated that one, more or each of the functions of the central controller as disclosed herein may be performed by one or more gaming device processors. It should be further appreciated that one, more or each of the functions of one or more gaming device processors as disclosed herein may be performed by the central controller.

In one embodiment, the game outcome for the game system game of any of the ancillary games described above is determined by a central server or controller and provided to the participant at the gaming device. In this embodiment, each of a plurality of such gaming devices are in communication with the central server or controller. Upon a participant initiating game play at one of the gaming devices, the initiated gaming device communicates a game outcome request to the central server or controller.

In one embodiment, the central server or controller receives the game outcome request and randomly generates an ancillary game outcome for the ancillary primary game based on probability data. In another embodiment, the central server or controller randomly generates a game outcome for the secondary game based on probability data. In another embodiment, the central server or controller randomly generates an ancillary game outcome for the primary game, the ancillary secondary game and any ancillary games based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined ancillary game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, an ancillary secondary game outcome, primary, secondary and ancillary game outcomes, or a series of game outcomes such as free games.

The central server or controller communicates the generated or selected game outcome to the initiated gaming device. The gaming device receives the generated or selected game outcome and provides the game outcome to the participant. In an alternative embodiment, how the generated or selected game outcome is to be presented or displayed to the participant, such as a ball landing on a designated space in a wheel, a reel symbol combination of a slot machine or a hand of cards dealt in a card game, is also determined by the central server or controller and communicated to the initiated gaming device to be presented or displayed to the participant. Central production or control can assist a gaming establishment or other entity in maintaining appropriate records, controlling gaming, reducing and preventing cheating or electronic or other errors, reducing or eliminating win-loss volatility and the like.

In another embodiment, a predetermined ancillary game outcome value is determined for each of a plurality of linked or networked gaming devices based on the results of a bingo, keno or lottery game. In this embodiment, each individual gaming device utilizes one or more bingo, keno or lottery games to determine the predetermined ancillary game outcome value provided to the participant for the interactive game played at that gaming device. In one embodiment, the bingo, keno or lottery game is displayed to the participant. In another embodiment, the bingo, keno or lottery game is not displayed to the participant, but the results of the bingo, keno or lottery game determine the predetermined game outcome value for the primary, secondary game or ancillary secondary game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card to each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination can be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the participant to engage a daub button (not shown) to initiate the process of the gaming device marking or flagging any selected elements.

After one or more predetermined patterns are marked on one or more of the provided bingo cards, an ancillary game outcome is determined for each of the enrolled gaming devices based, at least in part, on the selected elements on the provided bingo cards. As described above, the ancillary game outcome determined for each gaming device enrolled in the bingo game is utilized by that gaming device to determine the predetermined game outcome provided to the participant. For example, a first gaming device to have selected elements marked in a predetermined pattern is provided a first outcome of win $10 which will be provided to a first participant regardless of how the first participant plays in a first ancillary game and a second gaming device to have selected elements marked in a different predetermined pattern is provided a second outcome of win $2 which will be provided to a second participant regardless of how the second participant plays a second ancillary game. It should be appreciated that as the process of marking selected elements continues until one or more predetermined patterns are marked, this embodiment ensures that at least one bingo card will win the bingo game and thus at least one enrolled gaming device will provide a predetermined winning game outcome to a participant. It should be appreciated that other suitable methods for selecting or determining one or more predetermined game outcomes may be employed.

In one example of the above-described embodiment, the predetermined ancillary game outcome may be based on an ancillary award in addition to any award provided for winning the bingo game as described above. In this embodiment, if one or more elements are marked in ancillary patterns within a designated number of drawn elements, an ancillary or intermittent award or value associated with the marked ancillary pattern is provided to the participant as part of the predetermined ancillary game outcome. For example, if the four corners of a bingo card are marked within the first twenty selected elements, an ancillary award of $10 is provided to the participant as part of the predetermined ancillary game outcome. It should be appreciated that in this embodiment, the participant of a gaming device may be provided an ancillary or intermittent award regardless of if the enrolled gaming device's provided bingo card wins or does not win the bingo game as described above.

In another embodiment, one or more of the gaming devices are in communication with a central server or controller for monitoring purposes only. That is, each individual gaming device randomly generates the ancillary game outcomes to be provided to the participant and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a participant database for storing participant profiles, a participant tracking module for tracking participants and a credit system for providing automated casino transactions.

In one embodiment, the gaming device disclosed herein is associated with or otherwise integrated with one or more participant tracking systems. In this embodiment, the gaming device and/or participant tracking system tracks any participants gaming activity at the gaming device. In one such embodiment, the gaming device and/or associated participant tracking system timely tracks when a participant inserts their playing tracking card to begin a gaming session and also timely tracks when a participant removes their participant tracking card when concluding play for that gaming session. In another embodiment, rather than requiring a participant to insert a participant tracking card, the gaming device utilizes one or more portable devices carried by a participant, such as a cell phone, a radio frequency identification tag or any other suitable wireless device to track when a participant begins and ends a gaming session. In another embodiment, the gaming device utilizes any suitable biometric technology or ticket technology to track when a participant begins and ends a gaming session.

During one or more gaming sessions, the gaming device and/or participant tracking system tracks any suitable information, such as any amounts wagered, average wager amounts and/or the time these wagers are placed. In different embodiments, for one or more participants, the participant tracking system includes the participant's account number, the participant's card number, the participant's first name, the participant's surname, the participant's preferred name, the participant's participant tracking ranking, any promotion status associated with the participant's participant tracking card, the participant's address, the participant's birthday, the participant's anniversary, the participant's recent gaming sessions, or any other suitable data.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to each other.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, participants may access an internet game page from any location where an internet connection and computer, or other internet facilitator is available. The expansion in the number of computers and number and speed of internet connections in recent years increases opportunities for participants to play from an ever-increasing number of remote sites. It should be appreciated that enhanced bandwidth of digital wireless communications may render such technology suitable for some or all communications, particularly if such communications are encrypted. Higher data transmission speeds may be useful for enhancing the sophistication and response of the display and interaction with the participant.

As mentioned above, in one embodiment, the present disclosure may be employed in a server based gaming system. In one such embodiment, as described above, one or more gaming devices are in communication with a central server or controller. The central server or controller may be any suitable server or computing device which includes at least one processor and a memory or storage device. In alternative embodiments, the central server is a progressive controller or another gaming machine in the gaming system. In one embodiment, the memory device of the central server stores different game programs and instructions (including, but not limited to system 200), executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game, an ancillary game or a combination of such games. In another embodiment, the game program may be executable as an ancillary game to be played simultaneous with the play of a primary game (which may be downloaded to or fixed on the gaming device) or vice versa.

In this embodiment, each gaming device at least includes one or more display devices and/or one or more input devices for interaction with a participant. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, downloading or streaming the game program over a dedicated data network, internet or a telephone line. After the stored game programs are communicated from the central server, the local processor executes the communicated program to facilitate play of the communicated program by a participant through the display device(s) and/or input device(s) of the gaming device. That is, when a game program is communicated to a local processor, the local processor changes the game or type of game played at the gaming device.

In another embodiment, a plurality of gaming devices at one or more gaming sites may be networked to the central server in a progressive configuration, as known in the art, wherein a portion of each wager to initiate a base or primary game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming devices distributed throughout a number of properties at different geographical locations including, for example, different locations within a city or different cities within a state.

In one embodiment, the progressive gaming system host site computer is maintained for the overall operation and control of the progressive gaming system. In this embodiment, a progressive gaming system host site computer oversees the entire progressive gaming system and is the master for computing all progressive jackpots. All participating gaming sites report to, and receive information from, the progressive gaming system host site computer. Each central server computer is responsible for all data communication between the gaming device hardware and software and the progressive gaming system host site computer. In one embodiment, an individual gaming machine may trigger a progressive award win. In another embodiment, a central server (or the progressive gaming system host site computer) determines when a progressive award win is triggered. In another embodiment, an individual gaming machine and a central controller (or progressive gaming system host site computer) work in conjunction with each other to determine when a progressive win is triggered, for example through an individual gaming machine meeting a predetermined requirement established by the central controller.

In one embodiment, a progressive award win is triggered based on one or more game play events, such as a symbol-driven trigger. In other embodiments, the progressive award triggering event or qualifying condition may be by exceeding a certain amount of game play (such as number of ancillary games, number of credits, or amount of time), or reaching a specified number of points earned during game play. In another embodiment, a gaming device is randomly or apparently randomly selected to provide a participant of that gaming device one or more progressive awards. In one such embodiment, the gaming device does not provide any apparent reasons to the participant for winning a progressive award, wherein winning the progressive award is not triggered by an event in or based specifically on any of the plays of any primary game. That is, a participant is provided a progressive award without any explanation or alternatively with simple explanations. In another embodiment, a participant is provided a progressive award at least partially based on a game triggered or symbol triggered event, such as at least partially based on the play of a primary game.

In one embodiment, one or more of the progressive awards are each funded via a side bet or side wager. In this embodiment, a participant must place or wager a side bet to be eligible to win the progressive award associated with the side bet. In one embodiment, the participant must place the maximum bet and the side bet to be eligible to win one of the progressive awards. In another embodiment, if the participant places or wagers the required side bet, the participant may wager at any credit amount during the primary game (i.e., the participant need not place the maximum bet and the side bet to be eligible to win one of the progressive awards). In one such embodiment, the greater the participant's wager (in addition to the placed side bet), the greater the odds or probability that the participant will win one of the progressive awards. It should be appreciated that one or more of the progressive awards may each be funded, at least in part, based on the wagers placed on the primary games of the gaming machines in the gaming system, via a gaming establishment or via any suitable manner.

In another embodiment, one or more of the progressive awards are partially funded via a side-bet or side-wager which the participant may make (and which may be tracked via a side-bet meter). In one embodiment, one or more of the progressive awards are funded with only side-bets or side-wagers placed. In another embodiment, one or more of the progressive awards are funded based on participant's wagers as described above as well as any side-bets or side-wagers placed.

In one alternative embodiment, a minimum wager level is required for a gaming device to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system comprising:

a housing;

at least one display device supported by the housing;

a plurality of input devices supported by the housing, the plurality of input devices including an acceptor;

at least one processor; and at least one memory device that stores a plurality of instructions which, when executed by the at least one processor, cause the at least one processor to operate with the at least one display device and the plurality of input devices to:

(a) if a physical item associated with a monetary value is received via the acceptor, establish a credit balance based at least in part on the monetary value associated with the received physical item;

(b) after receiving an actuation of a wager button, place a wager on a single play of a modified Blackjack game, the modified Blackjack game being associated with:

(i) a plurality of rules including at least one player rule and at least one dealer rule, the at least one player rule and the at least one dealer rule being different; and (ii) at least one deck of cards;

(c) for a first round of said single play of the modified Blackjack game, form and display a first participant hand and a first game administrator hand from the at least one deck of cards, apply the at least one player rule to the first participant hand and the at least one dealer rule to the first game administrator hand, and determine a first round outcome;

(d) if a triggering event does not occur in association with the first round of the modified Blackjack game, for a second round of said single play of the modified Blackjack game:

(1) form and display a second participant hand and a second game administrator hand from the at least one deck of cards, apply the at least one dealer rule to the second participant hand and the at least one player rule to the second game administrator hand, and determine a second round outcome; and (2) determine any awards for the single play of the modified Blackjack game based on the wager, the first round outcome, and the second round outcome and display any determined awards;

(e) if the triggering event occurs in association with the first round of said single play of the modified Blackjack game, without providing the second round: (1) determine any awards for the single play of the modified Blackjack game based on the wager and the first round outcome, and (2) display any determined awards; and (f) if an actuation of a cashout button is received, initiate a payout associated with the credit balance.

2. The gaming system of claim 1, wherein the at least one dealer rule applied to the first game administrator hand is the same as the at least one dealer rule applied to the second participant hand.

3. The gaming system of claim 1, wherein the at least one player rule applied to the first participant hand is the same as the at least one player rule applied to the second game administrator hand.

4. The gaming system of claim 1, wherein the triggering condition occurs when the first game administrator hand is a Blackjack.

5. The gaming system of claim 1, wherein the triggering event does not occur when the first game administrator hand is a Blackjack and the first participant hand is a Blackjack.

6. A method of operating a gaming system, said method comprising:

(a) if a physical item associated with a monetary value is received via an acceptor, causing at least one processor to execute a plurality of instructions to establish a credit balance based at least in part of the monetary value associated with the received physical item;

(b) after receiving an actuation of a wager button, causing the at least one processor to execute the plurality of instructions to place a wager on a single play of a modified Blackjack game, the modified Blackjack game being associated with:

(i) a plurality of rules including at least one player rule and at least one dealer rule, the at least one player rule and the at least one dealer rule being different; and (ii) at least one deck of cards;

(c) for the first round of said single play of the modified Blackjack game, causing the at least one processor to execute the plurality of instructions to form and operate with at least one display device to display a first participant hand and a first game administrator hand from the at least one deck of cards, apply the at least one player rule to the first participant hand and the at least one dealer rule to the first game administrator hand, and determine a first round outcome;

(d) if a triggering event does not occur in association with the first round of the modified Blackjack game, for a second round of said single play of the modified Blackjack game:

(1) causing the at least one processor to execute the plurality of instructions to form and operate with the at least one display device to display a second participant hand and a second game administrator hand from the at least one deck of cards, apply the at least one dealer rule to the second participant hand and the at least one player rule to the second game administrator hand, and determine a second round outcome; and (2) causing the at least one processor to execute the plurality of instructions to determine any awards for the single play of the modified Blackjack game based on the wager, the first round outcome, and the second round outcome and operate with the at least one display device to display any determined awards; and (e) if the triggering event occurs in association with the first round of said single play of the modified Blackjack game, without providing the second round: (1) causing the at least one processor to execute the plurality of instructions to determine any awards for the single play of the modified Blackjack game based on the wager and the first round outcome, and (2) display any determined awards; and (f) if an actuation of a cashout button is received, causing the at least one processor to execute the plurality of instructions to initiate a payout associated with the credit balance.

7. The method of claim 6, wherein the at least one dealer rule applied to the first game administrator hand is the same as the at least one dealer rule applied to the second participant hand.

8. The method of claim 6, wherein the at least one player rule applied to the first participant hand is the same as the at least one player rule applied to the second game administrator hand.

9. The method of claim 6, wherein the triggering event occurs when the first game administrator hand is a Blackjack.

10. The method of claim 6, wherein the triggering event does not occur when the first game administrator hand is a Blackjack and the first participant hand is a Blackjack.

11. The method of claim 6, which is at least partially provided through a data network.

12. The method of claim 11, wherein the data network is an internet.

13. The gaming system of claim 1, which includes a table including at least one participant position and at least one game administrator position, the table including the at least one processor, the at least one display device, and the at least one memory device configured to perform (a) to (c).

14. The gaming system of claim 13, further including:

an electronic tracking system configured to store a plurality of the playing cards of the at least one deck of playing cards dealt in each round of said single play of the modified Blackjack game for each participant position and each game administrator position; and at least one image viewable by at least a game administrator, wherein the at least one processor is configured to:

(a) determine an action for the game administrator based on at least one of: the tracked cards, the at least one player rule, and the at least one dealer rule; and (b) cause the at least one image to graphically represent the action.

15. The gaming system of claim 14, wherein the at least one processor is configured to determine the action for the game administrator based on all revealed participant cards and all game administrator cards.

16. The gaming system of claim 13, wherein the table includes a plurality of participant positions.

17. The gaming system of claim 16, wherein the table includes a plurality of game administrator positions.

* * * * *